US011651883B2

(12) United States Patent
Morton et al.

(10) Patent No.: US 11,651,883 B2
(45) Date of Patent: May 16, 2023

(54) ELECTROMAGNET-SWITCHABLE PERMANENT MAGNET DEVICE

(71) Applicant: MAGSWITCH TECHNOLOGY WORLDWIDE PTY LTD, Lafayette, CO (US)

(72) Inventors: David H. Morton, Boulder, CO (US); Thomas R. Whitt, Redmond, WA (US); Michael H. Reed, Westminster, CO (US); Michael C. Blanchard, Thornton, CO (US)

(73) Assignee: MAGSWITCH TECHNOLOGY WORLDWIDE PTY LTD., Superior, CO (US)

( * ) Notice: Subject to any disclaimer, the term of this patent is extended or adjusted under 35 U.S.C. 154(b) by 0 days.

(21) Appl. No.: 17/340,557

(22) Filed: Jun. 7, 2021

(65) Prior Publication Data

US 2021/0296039 A1 Sep. 23, 2021

Related U.S. Application Data

(63) Continuation of application No. 16/618,690, filed as application No. PCT/US2018/036734 on Jun. 8, 2018, now Pat. No. 11,031,166.

(Continued)

(51) Int. Cl.

*H01F 7/20* (2006.01)
*H01F 7/02* (2006.01)

(Continued)

(52) U.S. Cl.

CPC ..... *H01F 7/206* (2013.01); *B66C 1/06* (2013.01); *H01F 7/0257* (2013.01); *H01F 7/04* (2013.01); *H01F 7/17* (2013.01); *H01F 2007/208* (2013.01)

(58) Field of Classification Search

CPC ..... H01F 7/206; H01F 7/0257; H01F 7/04; H01F 7/17; H01F 2007/208; B66C 1/06

See application file for complete search history.

(56) References Cited

U.S. PATENT DOCUMENTS 2,863,550 A 12/1958 Hommel
2,947,429 A 8/1960 Buccicone (Continued)

FOREIGN PATENT DOCUMENTS

CN 2179359 Y 10/1994
CN 1104989 A 7/1995

(Continued)

OTHER PUBLICATIONS

Ixtur Automatic On/Off Lifting Magnets; Industrial Magnetics, Inc., magnetics.com, Nov. 1, 2015, https://web.archive.org/web/20151101101715/https://www.magnetics.com product.asp?ProductID=169, two pages.

(Continued)

*Primary Examiner* — Mohamad A Musleh

(74) *Attorney, Agent, or Firm* — Faegre Drinker Biddle & Reath LLP

(57) ABSTRACT

A switchable permanent magnetic unit is disclosed. The unit comprises: a housing, first and second permanent magnets, and a conductive coil. The first magnet is mounted within the housing and the second magnet is rotatable between first and second positions and mounted within the housing in a stacked relationship with the first magnet. The unit generates a first level of magnetic flux at a workpiece contact interface when the second magnet is in the first position and a second level of magnetic flux at the interface when the second magnet is in the second position, the second level being greater than the first level. The conductive coil is arranged about the second magnet and generates a magnetic field. A component of the conductive coil's magnetic field is (Continued)

directed from S to N along the second magnet's N-S pole pair when the second magnet is in the first position.

12 Claims, 11 Drawing Sheets

Related U.S. Application Data

(60) Provisional application No. 62/517,057, filed on Jun. 8, 2017.

(51) Int. Cl.

| | |
|---|---|
| ***H01F 7/04*** | (2006.01) |
| ***H01F 7/17*** | (2006.01) |
| ***B66C 1/06*** | (2006.01) |

(56) References Cited

U.S. PATENT DOCUMENTS

| | | | |
|---|---|---|---|
| 3,089,064 | A | 5/1963 | Cotton De Bennetot |
| 3,316,514 | A | 4/1967 | Radus et al. |
| 3,355,209 | A | 11/1967 | Richards et al. |
| 3,452,310 | A | 6/1969 | Israelson |
| 3,646,669 | A | 3/1972 | Erickson |
| 3,895,270 | A | 7/1975 | Maddox |
| 4,314,219 | A | 2/1982 | Haraguchi |
| 4,384,313 | A | 5/1983 | Steingroever et al. |
| 4,465,993 | A | 8/1984 | Braillon |
| 4,594,568 | A | 6/1986 | Hubner et al. |
| 4,610,580 | A | 9/1986 | Palm |
| 4,639,170 | A | 1/1987 | Palm |
| 4,921,292 | A | 5/1990 | Harwell et al. |
| 4,956,625 | A | 9/1990 | Cardone et al. |
| 5,525,950 | A | 6/1996 | Wang |
| 5,794,497 | A | 8/1998 | Anderson |
| 6,076,873 | A | 6/2000 | Jung |
| 6,104,270 | A | 8/2000 | Elias |
| 6,160,697 | A | 12/2000 | Edel |
| 6,229,422 | B1 | 5/2001 | Pignataro |
| 6,331,810 | B1 | 12/2001 | Jung |
| 6,489,871 | B1 | 12/2002 | Barton |
| 6,573,817 | B2 | 6/2003 | Gottschalk |
| 6,636,153 | B1 | 10/2003 | Barton et al. |
| 6,663,154 | B2 | 12/2003 | Pancheri |
| 6,707,360 | B2 | 3/2004 | Underwood et al. |
| 7,012,495 | B2 | 3/2006 | Underwood et al. |
| 7,049,919 | B2 | 5/2006 | Yamaki |
| 7,148,777 | B2 | 12/2006 | Chell et al. |
| 7,161,451 | B2 | 1/2007 | Shen |
| 7,396,057 | B2 | 7/2008 | Ye et al. |
| 8,031,038 | B2 | 10/2011 | Kimura |
| 8,157,155 | B2 | 4/2012 | Diez et al. |
| 8,183,965 | B2 | 5/2012 | Michael |
| 8,256,098 | B2 | 9/2012 | Michael |
| 8,350,663 | B1 | 1/2013 | Michael |
| 8,604,900 | B2 | 12/2013 | Kocijan |
| 8,878,639 | B2 | 11/2014 | Kocijan |
| 8,907,754 | B2 | 12/2014 | Barton et al. |
| 8,934,210 | B1 | 1/2015 | Denis et al. |
| 9,164,154 | B2 | 10/2015 | Filosa et al. |
| 9,202,616 | B2 | 12/2015 | Fullerton et al. |
| 9,232,976 | B2 | 1/2016 | Fortier et al. |
| 9,242,367 | B2 | 9/2016 | Timmons et al. |
| 9,453,769 | B2 | 9/2016 | Michael |
| 9,484,137 | B2 | 11/2016 | Kocijan |
| 9,589,715 | B2 | 3/2017 | Choi |
| 9,818,522 | B2 | 11/2017 | Kocijan |
| 10,903,030 | B2 | 1/2021 | Morton et al. |
| 11,031,166 | B2 | 6/2021 | Morton et al. |
| 11,097,401 | B2 | 8/2021 | Morton et al. |
| 2004/0239460 | A1 | 12/2004 | Kocijan |
| 2005/0012579 | A1 | 1/2005 | Underwood et al. |
| 2010/0201468 | A1 | 8/2010 | Pohl et al. |
| 2010/0301839 | A1 | 12/2010 | Cardone et al. |
| 2011/0248806 | A1 | 10/2011 | Michael |
| 2013/0135067 | A1 | 5/2013 | Choi |
| 2013/0234817 | A1 | 9/2013 | Kocijan |
| 2013/0285399 | A1 | 10/2013 | Sarh et al. |
| 2013/0320686 | A1 | 12/2013 | Morton |
| 2014/0055069 | A1 | 2/2014 | Dai et al. |
| 2014/0132254 | A1 | 5/2014 | Thomas et al. |
| 2014/0314507 | A1 | 10/2014 | Timmons et al. |
| 2015/0035632 | A1 | 2/2015 | Sarh et al. |
| 2016/0187208 | A1 | 6/2016 | Michael |
| 2016/0289046 | A1 | 10/2016 | Norton et al. |
| 2017/0011831 | A1 | 1/2017 | Natti |
| 2017/0232605 | A1 | 8/2017 | Morton |
| 2018/0111237 | A1 | 4/2018 | Michael |
| 2018/0193899 | A1 | 7/2018 | Kizilkan |
| 2018/0311795 | A1* | 11/2018 | Morton ..... H01F 7/0257 |
| 2018/0315563 | A1 | 11/2018 | Morton et al. |
| 2020/0185137 | A1 | 6/2020 | Morton et al. |
| 2021/0031317 | A1 | 2/2021 | Morton et al. |
| 2021/0031335 | A1 | 2/2021 | Morton et al. |
| 2021/0122011 | A1 | 4/2021 | Kitaura et al. |
| 2021/0210296 | A1 | 7/2021 | Morton et al. |
| 2021/0268615 | A1 | 9/2021 | Morton et al. |

FOREIGN PATENT DOCUMENTS

| | | | |
|---|---|---|---|
| CN | 1402876 | A | 3/2003 |
| CN | 1245725 | C | 3/2006 |
| CN | 101274727 | A | 10/2008 |
| CN | 101356597 | A | 1/2009 |
| CN | 101711194 | A | 5/2010 |
| CN | 201689754 | U | 12/2010 |
| CN | 102574668 | A | 7/2012 |
| CN | 202704790 | U | 1/2013 |
| CN | 103332585 | A | 10/2013 |
| CN | 103563019 | A | 2/2014 |
| CN | 104276506 | A | 1/2015 |
| CN | 105684102 | A | 6/2016 |
| CN | 105940468 | A | 9/2016 |
| CN | 106102993 | A | 11/2016 |
| CN | 206617466 | U | 11/2017 |
| DE | 202016006696 | U1 | 12/2016 |
| EP | 1425763 | A1 | 6/2004 |
| EP | 1419034 | B1 | 7/2006 |
| EP | 2218557 | A2 | 8/2010 |
| EP | 2611569 | A1 | 7/2013 |
| EP | 2535307 | B1 | 4/2015 |
| EP | 3100288 | B1 | 3/2018 |
| EP | 3460411 | A1 | 3/2019 |
| GB | 0695130 | A | 8/1953 |
| GB | 1471025 | A | 4/1977 |
| JP | 63-015404 | A | 1/1988 |
| JP | 04-207002 | A | 7/1992 |
| JP | 2608002 | B2 | 5/1997 |
| JP | 10-012432 | A | 1/1998 |
| JP | 2002144271 | A | 5/2002 |
| JP | 2007-208024 | A | 8/2007 |
| JP | 2013219364 | A | 10/2013 |
| JP | 2014-081002 | A | 5/2014 |
| JP | 5798208 | B2 | 10/2015 |
| JP | 2017506818 | A | 3/2017 |
| KR | 10-2003-0007387 | A | 1/2003 |
| KR | 10-2009-0035432 | A | 4/2009 |
| KR | 1020120130040 | A | 11/2012 |
| KR | 10-2013-0063129 | A | 6/2013 |
| WO | 99/08293 | A1 | 2/1999 |
| WO | 0143147 | A1 | 6/2001 |
| WO | 03/09972 | A2 | 2/2003 |
| WO | 03/19583 | A1 | 3/2003 |
| WO | 2008142716 | A2 | 11/2008 |
| WO | 2009/000008 | A1 | 12/2008 |
| WO | 2010/020006 | A1 | 2/2010 |
| WO | 2010/135788 | A1 | 12/2010 |
| WO | 2012/029073 | A1 | 3/2012 |
| WO | 2012/160262 | A1 | 11/2012 |
| WO | 2014/033757 | A1 | 3/2014 |
| WO | 2015/033851 | A1 | 3/2015 |
| WO | 2015/114214 | A1 | 8/2015 |

(56) References Cited

FOREIGN PATENT DOCUMENTS

| | | | |
|---|---|---|---|
| WO | 2016/162419 | A1 | 10/2016 |
| WO | 2018/200948 | A1 | 11/2018 |
| WO | 2018/227140 | A1 | 12/2018 |

OTHER PUBLICATIONS

"MagnaGrip SS Sensing System" https://www.maglogix.com/maglogix-switchable-permanent-magnets-magnagrip, copyright 2014-2017, printed Jul. 20, 2019, (5 pages).
"MaxX The hand controlled magnetic lifter", Tecnomagnete, Oct. 2008, (16 pages).
"Pick & Place For End-of-Arm Tooling", DocMagnet, undated, (5 pages).
"Pick 'n Place D Series", DocMagnet, retrieved from https://web.archive.org/web/20150512113557/http://www.docmagnet.com:80/products/magnetic-material-handling/automation/pick-n-place-d-series/, May 12, 2015, (4 pages).
"RPL 11 ERIEZ Lifting Magnet 1,100 lb Hoist or Crane," eBay, ebay.com, seller: industrial_supplies_warehouse, ebay Item No. 263279261219, accessed: Oct. 2017. https://www.ebay.com/itm/RPL-11-ERIEZ-Lifting-Magnet-1-100-lb-Hoist-or-Crane-/263279261219.
Ara Nerses Knaian: "Electropermanent Magnetic Connectors and Actuators: Devices and Their Application in Programmable Matter", PhD Thesis., Massachusetts Institute of Technology, 2010, pp. 1-206.
Examination Report for Indian Application No. 201917053528, dated Jun. 22, 2020, 5 pages.
Extended European Search Report for European Application No. 18792036.8, dated Dec. 8, 2020, 8 pages.
International Preliminary Report on Patentability received for PCT Patent Application No. PCT/US2018/029786, dated Nov. 7, 2019, 10 pages.
International Preliminary Report on Patentability received for PCT Patent Application No. PCT/US2018/036734, dated Dec. 19, 2019, 7 pages.
International Preliminary Report on Patentability received for PCT Patent Application No. PCT/US2019/019179, dated Sep. 3, 2020, 9 pages.
International Preliminary Report on Patentability received for PCT Patent Application No. PCT/US2019/027267, dated Nov. 5, 2020, 11 pages.
International Search Report and Written Opinion of the International Searching Authority, Australian Patent Office, PCT/US2018/029786 to Magswitch Technology Worldwide PTY Ltd. et al., Aug. 21, 2018, 17 pages.
International Search Report and Written Opinion received for PCT Patent Application No. PCT/US2018/036734, dated Sep. 4, 2018, 10 pages.
International Search Report and Written Opinion received for PCT Patent Application No. PCT/US2019/019179, dated Jun. 24, 2019, 14 pages.
International Search Report and Written Opinion received for PCT Patent Application No. PCT/US2019/027267, dated Jul. 17, 2019, 27 pages.
Knaian, "Electropermanent Magnetic Connectors and Actuators: Devices and Their Application in Programmable Matter", PhD Thesis, Massachusetts Institute of Technology, 2010 (206 pages).
Material Handling Catalogue, DocMagnet, undated, (8 pages).
Official Action for Canadian Application No. 3,061,331, dated Feb. 9, 2021, 3 pages.
Search Report and First Office Action for Chinese Application No. 2018800408500, dated Apr. 6, 2021, 16 pages.
The Wayback Machine—https://web.archive.org/web/20170405061444/https7/en.wikipedia.org/wiki/Electropermanent_magnet, (dated Apr. 5, 2017; retrieved Oct. 11, 2021), (9 pages).
U.S. Appl. No. 62/248,804, filed Oct. 30, 2015, (64 pages).

* cited by examiner

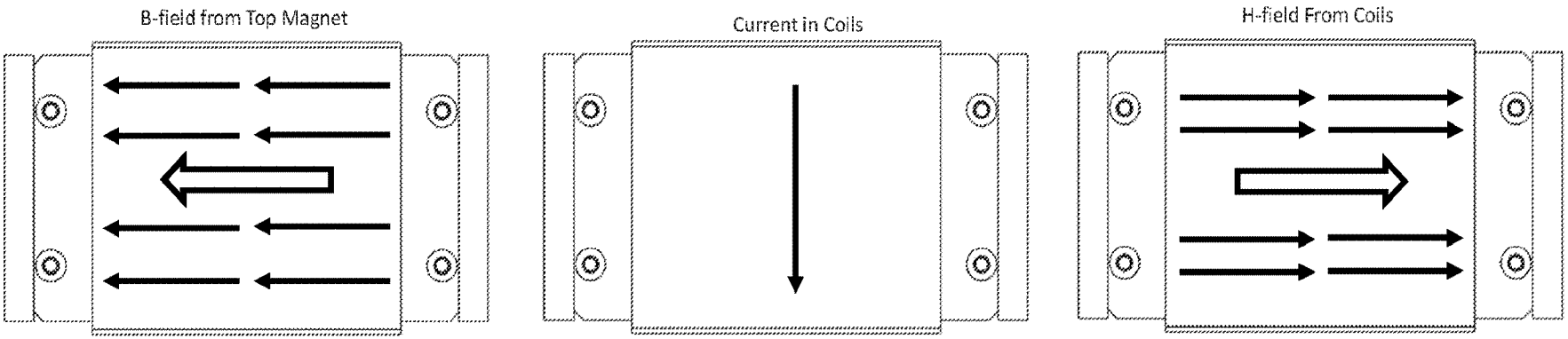
FIG. 4A
FIG. 4B
FIG. 4C
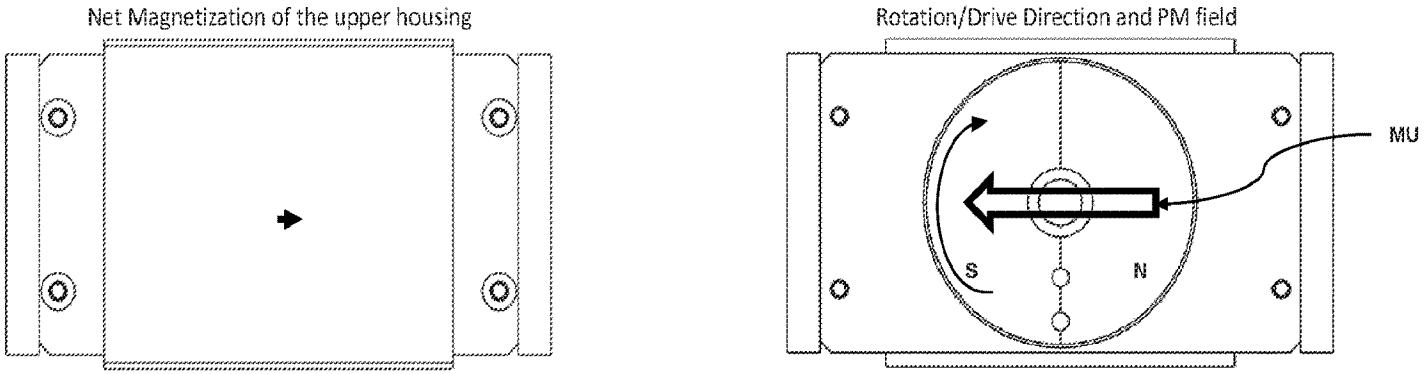
FIG. 4D
FIG. 4E

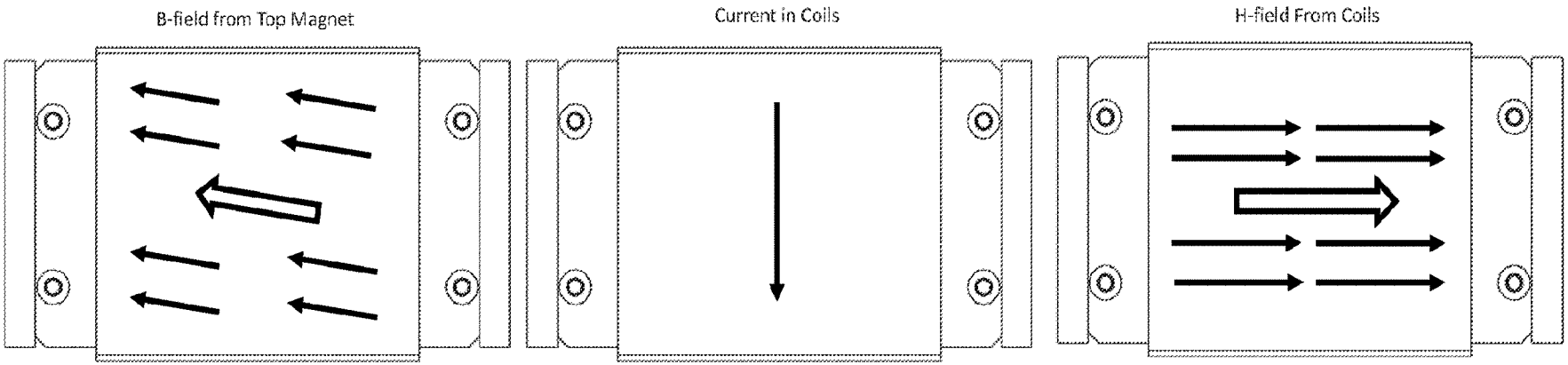
FIG. 5A
FIG. 5B
FIG. 5C
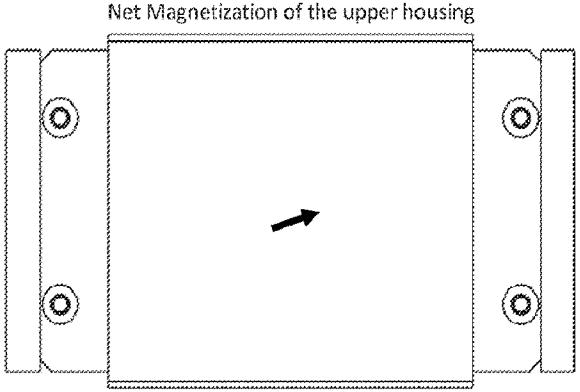
FIG. 5D
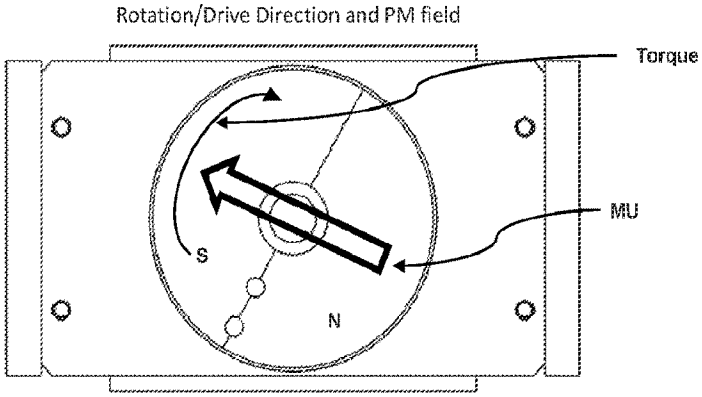
FIG. 5E

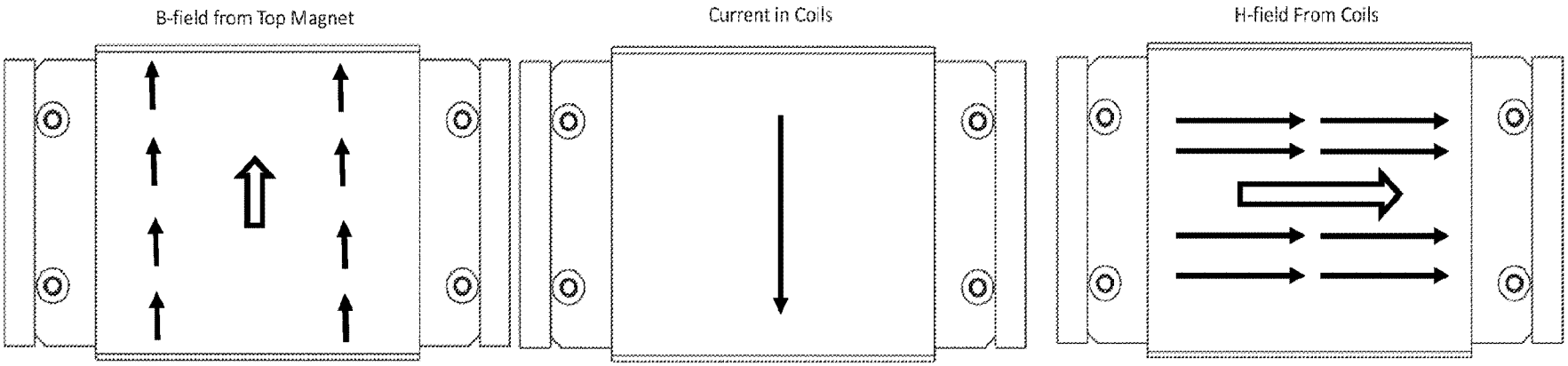
FIG. 6A
FIG. 6B
FIG. 6C
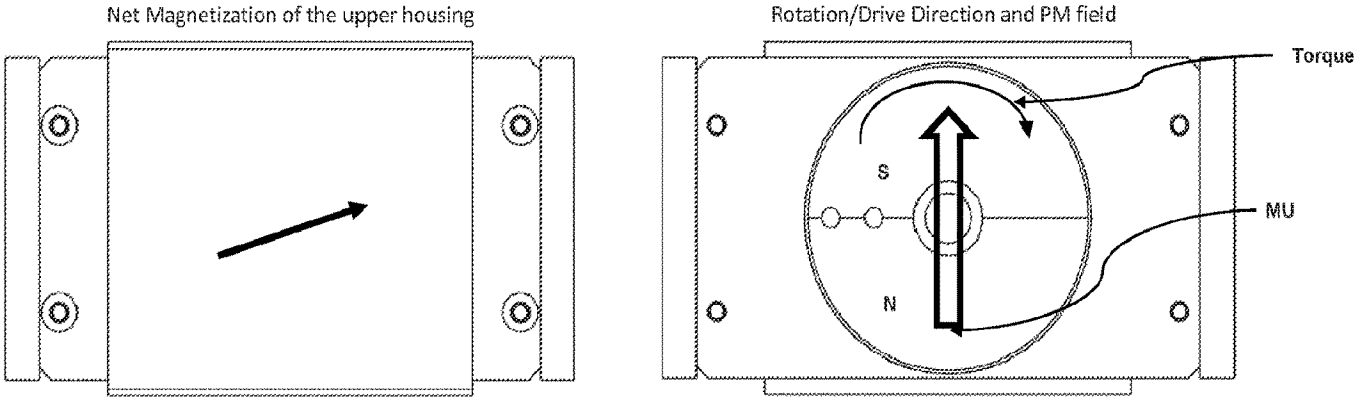
FIG. 6D
FIG. 6E

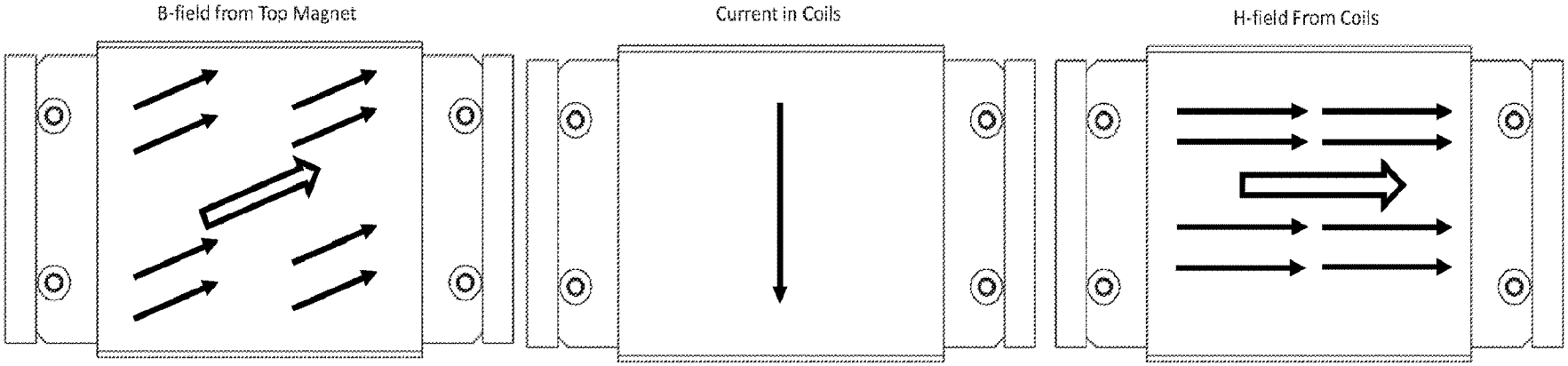
FIG. 7A
FIG. 7B
FIG. 7C
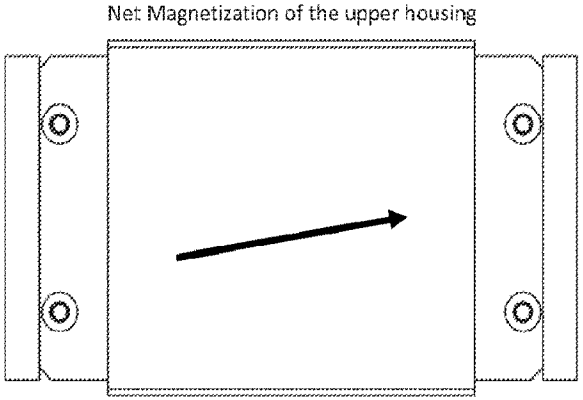
FIG. 7D
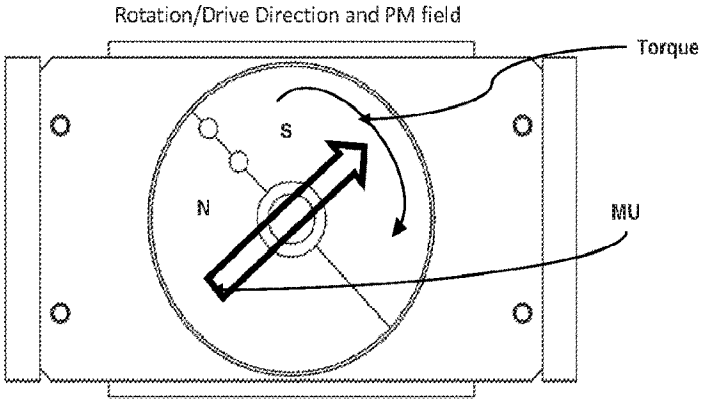
FIG. 7E

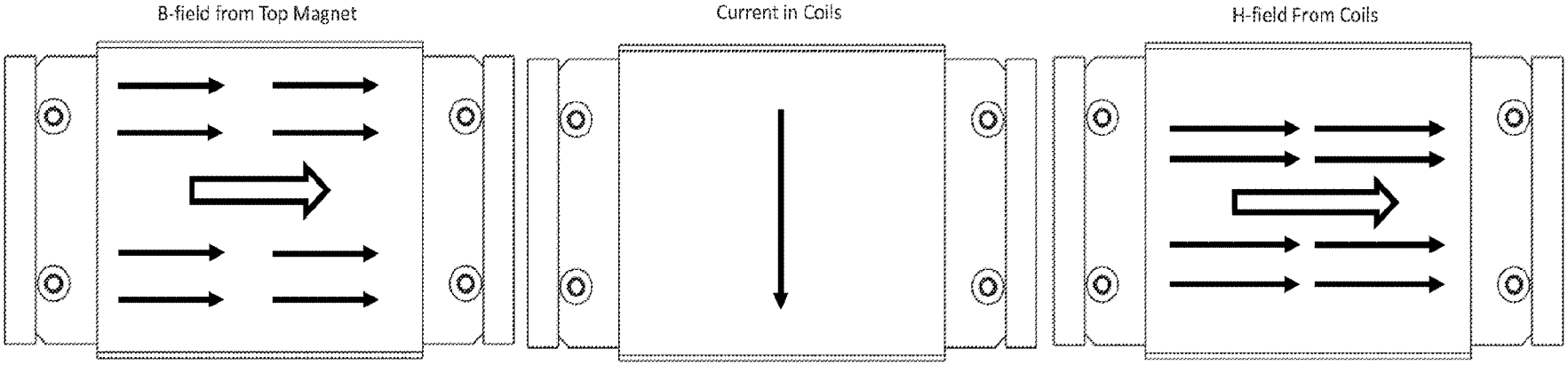
FIG. 8A
FIG. 8B
FIG. 8C
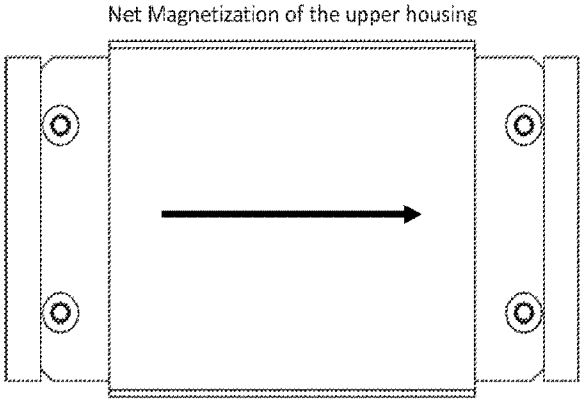
FIG. 8D
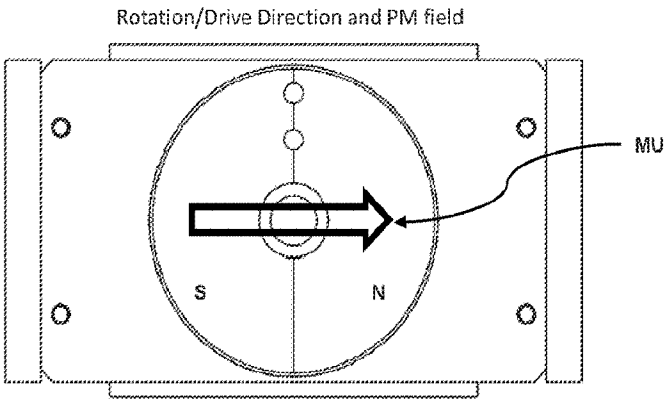
FIG. 8E

Stop at 'On' Position

ELECTROMAGNET-SWITCHABLE PERMANENT MAGNET DEVICE

RELATED APPLICATIONS

The present application is a continuation of U.S. patent application Ser. No. 16/618,690, filed Dec. 2, 2019, issued as U.S. Pat. No. 11,031,166, which is a U.S. National Phase filing of PCT/US2018/036734, filed Jun. 8, 2018, which claims the benefit of U.S. Provisional Patent Application No. 62/517,057, titled ELECTROMAGNETIC-SWITCHABLE PERMANENT MAGNET DEVICE, filed Jun. 8, 2017, the entire disclosures of which are expressly incorporated by reference herein.

TECHNICAL FIELD

The present disclosure relates to magnetic devices. More specifically, the present disclosure relates to switchable magnetic devices that can be switched between magnetically attractive "on" states and non-attractive "off" states.

BACKGROUND

Switchable magnetic devices may be used to magnetically couple the magnetic device to one or more ferromagnetic work pieces. Switchable magnetic devices may include one or more magnet(s) that is (are) rotatable relative to one or more stationary magnet(s), in order to generate and shunt a magnetic field. The switchable magnet device may be attached in a removable manner, via switching the magnet device between an "on" state and an "off" state, to a ferromagnetic object (work piece), such as for object lifting operations, material handling, material holding, magnetically latching or coupling objects to one another, amongst a plethora of application fields.

SUMMARY

Example embodiments of disclosure provided herein include the following.

In an exemplary embodiment of the present disclosure, A switchable permanent magnetic unit for magnetically coupling to a ferromagnetic workpiece is provided. The magnetic unit comprises: a housing; a first permanent magnet mounted within the housing and having an active N-S pole pair; a second permanent magnet rotatably mounted within the housing in a stacked relationship with the first permanent magnet and having an active N-S pole pair, the second permanent magnet being rotatable between a first position and a second position, the switchable permanent magnetic unit having a first level of magnetic flux available to the ferromagnetic workpiece at a workpiece contact interface of the switchable permanent magnetic unit when the second permanent magnet is in the first position and having a second level of magnetic flux available to the ferromagnetic workpiece at the workpiece contact interface when the second permanent magnet is in the second position, the second level being greater than the first level; and at least one conductive coil arranged about the second permanent magnet and configured to generate a magnetic field in response to a current being transmitted through the at least one conductive coil, wherein a component of the conductive coil's magnetic field is directed from S to N along the active N-S pole pair of the second permanent magnet when the second permanent magnet is in the first position.

In an example thereof, the switchable permanent magnetic unit further comprises a means to hold the second permanent magnet in the second position.

In a variation of the example thereof, the switchable permanent magnetic unit comprises a rotation limiter configured to hold the second permanent magnet in the second position.

In another variation of the example thereof, the at least one conductive coil is arranged about the first permanent magnet and the second permanent magnet.

In still another variation of the example thereof, the conductive coil is arranged about an exterior face of the housing.

In yet another variation of the example thereof, the conductive coil is disposed within the housing and about an exterior face of the second permanent magnet.

In still another variation of the example thereof, the active N-S pole pair of the first permanent magnet comprises more than one active N-S pole pair and the active N-S pole pair of the second permanent magnet comprising more than one active N-S pole pair.

In another example thereof, the switchable permanent magnetic unit comprises a power supply configured to supply current to the conductive coil for generating the conductive coil's magnetic field.

In yet another example thereof, the component directed from S to N along the N-S pole pair of the second permanent magnet's N-S pole pair comprises all of the conductive coil's magnetic field.

In still another example thereof, the housing is a two-piece housing.

In another example thereof, the housing is a single-piece housing.

In another exemplary embodiment of the present disclosure a method of manufacturing a switchable permanent magnetic unit is provided. The switchable permanent magnetic unit is configured to magnetically couple to a ferromagnetic workpiece at a workpiece contact interface of the switchable permanent magnetic unit. The method comprises: mounting a first permanent magnet in a housing, the first permanent magnet having an active N-S pole pair; mounting a second permanent magnet in a stacked relationship with the first permanent magnet within the housing, the second permanent magnet having an active N-S pole pair, the second permanent magnet being rotatable relative to the first permanent magnet between a first position and a second position, the switchable permanent magnetic unit having a first level of magnetic flux available to the ferromagnetic workpiece at the workpiece contact interface when the second permanent magnet is in the first position and having a second level of magnetic flux available to the ferromagnetic workpiece at the workpiece contact interface when the second permanent magnet is in the second position, the second level being greater than the first level; and arranging at least one conductive coil about the second permanent magnet, the at least one conductive coil configured to generate a magnetic field in response to a current being transmitted through the conductive coil, a component of the magnetic field being directed from S to N along the active N-S pole pair of the second permanent magnet when the second permanent magnet is in the first position.

In an example thereof, the at least one conductive coil is arranged about an exterior face of the housing.

In a variation of the example thereof, the at least one conductive coil is arranged within the housing and about an exterior face of the second permanent magnet.

In yet another variation of the example thereof, the at least one conductive coil is arranged about the first permanent magnet and the second permanent magnet.

In still another variation of the example thereof, the method further comprises including a means configured to hold the second permanent magnet in the second position.

In a variation of the example thereof, the method further comprises including a rotation limiter configured to limit rotation of the second permanent magnet within a set rotational range with respect to the first permanent magnet.

In yet another variation of the example thereof, at least one of: the first permanent magnet and the second permanent comprise a plurality of permanent magnets.

In still another variation of the example thereof, the method further comprises coupling a power supply to the conductive coil, the power supply being configured to supply current to the conductive coil for inducing the conductive coil's magnetic field.

In another example thereof, the housing is a two-piece housing.

In yet another example thereof, the housing is a single-piece housing.

Other aspects and optional and/or preferred features of the invention will become apparent from the following description of a preferred embodiment provided below with reference to the accompanying drawings.

BRIEF DESCRIPTION OF THE DRAWINGS

FIGS. 4A-4E to FIGS. 8A-8E are top views of the device depicted in FIGS. 1 and 2 sequentially switching from an "off" position to an "on" position, in accordance with embodiments of the present disclosure.

Figure 1:
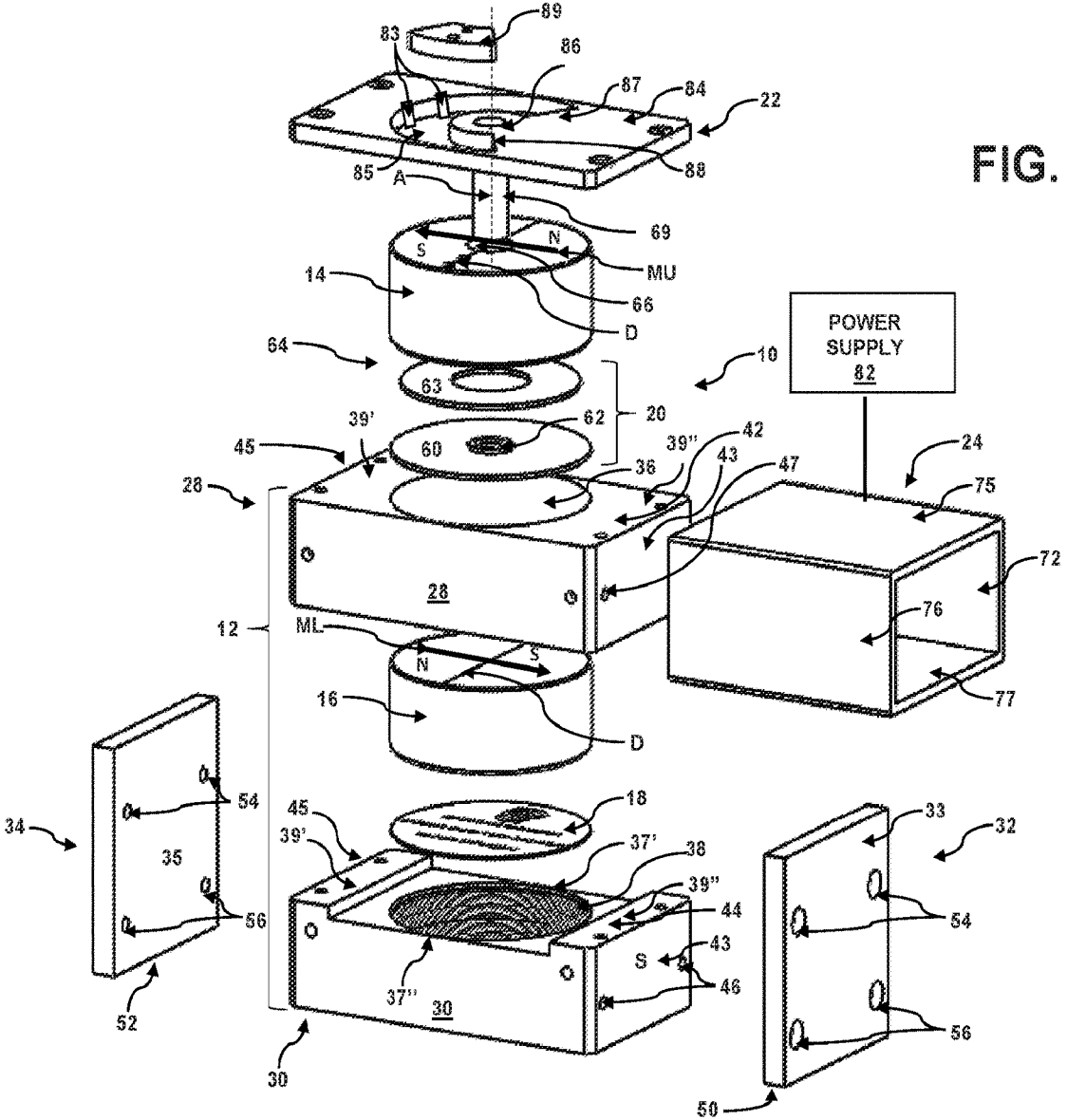
FIG. 1 is a schematic exploded view of an electrically switchable, permanent magnetic device, in accordance with embodiments of the present disclosure.

While the disclosed subject matter is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

It will be understood that the terms and adjectives 'vertical', 'horizontal' 'upper', 'lower', 'top', 'bottom', 'sideways', 'lateral', 'widthward', etc. are merely used in this description and in the specification to provide reference indicators to facilitate understanding of the drawings and relationship of components to one another.

Switchable magnetic devices may be actuated using manual actuation, pneumatic or hydraulic actuation, and/or electric actuation. Manual actuation is where one or more magnets or magnetic units are directly rotated or moved in linear fashion with respect to one or more stationary magnets or magnetic units, by means of a handle or a manual actuator. Embodiments provided herein relate to switchable magnetic devices. Exemplary manual switchable magnetic devices are disclosed in U.S. Pat. No. 7,012,495, titled SWITCHABLE PERMANENT MAGNETIC DEVICE (the '495 Patent"); U.S. Provisional Patent Application No. 62/248,804, filed Oct. 30, 2015, titled MAGNETIC COUPLING DEVICE WITH A ROTARY ACTUATION SYSTEM, and U.S. Provisional Patent Application No. 62/252,435, filed Nov. 7, 2015, titled MAGNETIC COUPLING DEVICE WITH A LINEAR ACTUATION SYSTEM, the entire disclosures of which are expressly incorporated by reference herein.

Pneumatic or hydraulic actuation is where one or more moveable magnets or magnet units of a switchable magnet core device is driven by a pneumatic or hydraulic fluid actuator.

Electric actuation usually falls into one of two categories. The first category includes an "electromechanical permanent magnet" (or EPM) devices with two (or more) stationary permanent magnets cooperating with a ferromagnetic armature and a conductive coil (e.g., a solenoid coil) wrapped about the armature or the magnets proper. The two magnets have different magnetization and coercivity properties, and the conductive coil is rated to temporarily offset a magnetic field of one of the magnets by superimposing an electrically generated magnetic field, for switching the device from an active into a deactivated state in a bistable fashion. In embodiments, the magnetic field produced by the conductive coil may not affect the other stationary magnet. These devices typically rely upon a high coercivity permanent magnet member, which cannot be easily demagnetized by an external magnetizing influence, and a second magnetic element comprised of a medium or low coercivity magnetic element, which is located to cooperate with the conductive coil so it can be magnetized by the magnetic field of the coil to either align or anti-align its magnetization vector with the high coercivity magnet also present in the magnetic circuit.

The second category of electric actuation comprises permanent magnetic devices similar to those referred to above, where an electric motor is used to impart torque onto a movable magnet using a shaft or other type of transmission mechanism coupled to the output shaft of the electromotor.

Due to the lack of moving parts, as well as the increased efficiency of directly magnetizing a medium or low coercivity element as compared to using a separate driving motor, the first category is the more commonly used method for electrically switching a magnet between on and off states.

Electrical actuation of switchable magnet systems has some advantages over manual and pneumatic actuation systems. As electrical control systems and power systems are now widespread, and with the expansion of magnetic switch technologies into consumer products which themselves require electric power for operating, using electric power to effect switching is less cumbersome than the use of hydraulic or pneumatic actuators which require working fluid sources not commonly available other than in industrial and manufacturing plant settings.

Notwithstanding their advantages, existing EPM devices have a number of disadvantages. The more commonly encountered AlNiCo/NdFeB EPM devices employ AlNiCo as the working material which switches between magnetisation states, see e.g. the PH thesis of Ara Nerses Knaian, at http://cba.mit.edu/docs/theses/10.06.knaian.pdf Though AlNiCo is a powerful magnetic material, with a high residual induction and the highest non-rare-earth-magnet energy product, it is characterized by a surprisingly low coercivity. Though this low coercivity is what allows the EPM technology to work, it also decreases the performance of EPM devices.

If EPM devices are used in a complete, large cross section magnetic circuit, then the total flux density output should be equivalent to the same volume of NdFeB. However, if this technique is used in a poor or heavily loaded magnetic circuit, the unfavorable magnetization curve of the AlNiCo, due to its low coercivity, leads to a massive decrease in the usable (pulling) force of the system. This limits application range for most EPM units to situations where they will be well and fully saturated.

In addition, due to the large amount of current required by the solenoid electromagnets to bring a piece of permanent magnetic material to full saturation against an opposing magnetic field, EPM devices require rather excessive power draw to switch the system between on and off states. This requires large power handling circuitry and controls for even small magnetic range units, limiting the portability and setup flexibility of these systems.

Electric motor powered actuation systems on the other hand have the advantage of having an extremely broad operating range in terms of torque—as the variation of torque required to actuate a switchable permanent magnet over a full cycle is substantial, even in the presence of an external magnetic circuit.

When an electric motor is used with switchable permanent magnet devices, it is difficult for the motor to be "tuned" into an ideal operating point, as the operating conditions of the motor must vary wildly to cater for various applications and situations to which the magnet unit is applied. In addition, the requirement of mechanical coupling elements and possibly gearboxes, which increase weight and complexity, and the associated losses means that motor-driven magnets are significantly less efficient than the direct-magnetization EPM approach detailed above. The large number of moving components and the large amount of stress on those components also reduces lifetime of parts and prevents effective miniaturization and size minimization for almost any EPM unit.

It is one aim of the present disclosure to improve on existing EPM devices by providing a design allowing use of permanent magnets having similar coercivity characteristics while reducing the amount of electric power required to switch the device between magnetization states. It is another aim of the present disclosure to provide a modified permanent magnetic switchable device in which activation and deactivation of the device is effected by relative movement of permanent magnets included in the switchable device, by providing an alternate way of imparting torque (or force) onto the movable magnet to alter its relative position with respect to the stationary magnet in order to switch the device between on and off magnetization states.

Embodiments of the present disclosure were initially conceived in order to facilitate, improve or provide a different mechanism for actuating (switching on and off) a switchable permanent magnet device such as for example the magnet device disclosed in the '495 patent. Embodiments of the present disclosure may utilize some of the basic concepts of the '495 patent, but as the skilled reader will immediately appreciate from the following description, embodiments of the present disclosure are not limited to devices that are similar to the ones described in the '495 patent. For example, whilst the '495 patent uses two unitary, cylindrical, diametrically magnetized rare earth permanent magnets as the source of magnetic flux, embodiments of the present disclosure can be implemented in other types of devices, such as for example the devices described in the U.S. Pat. Nos. 8,878,639, 7,161,451, German Utility Model DE202016006696U1, and U.S. Provisional Patent Application No. 62/248,804, filed Oct. 30, 2015, titled MAGNETIC COUPLING DEVICE WITH A ROTARY ACTUATION SYSTEM, the entire disclosures of which are expressly incorporated by reference herein.

The skilled reader will note that the term "magnet" as appears in this description has to be understood in context. That is, the term "magnet" may denote a permanent magnetic body, e.g., a cylindrical unitary di-pole body of a single type of rear earth magnet material, such as NdFeB or SmCo, or a composite body comprising a core of such rare earth materials to which are affixed pole extension bodies of low magnetic reluctance material (generally referred to as ferromagnetic passive pole pieces), amongst others. Furthermore, the term "magnet" strictly speaking may also denote electromagnets, and conductive coils (e.g., solenoid coils) with or without ferromagnetic core elements.

In embodiments, a pair of identical, diametrically magnetized cylindrical di-pole permanent magnets are arranged in an active shunting arrangement within a purpose-designed ferromagnetic two-piece housing to which are secured a pair of passive ferromagnetic pole elements (also called 'shoes'). A ferromagnetic work piece may be coupled with the magnets via the pole shoes. Such device can be incorporated in many different appliances where magnetic attraction is used to temporarily retain a ferromagnetic body on a tool, such as a lifting device, coupling appliance, end-of-arm robotic work piece handling devices, latches, etc.

For a description of the basic concept behind such switchable permanent magnetic devices reference should be made to the '495 patent, the contents of which is herein incorporated for all purposes.

Figure 2:
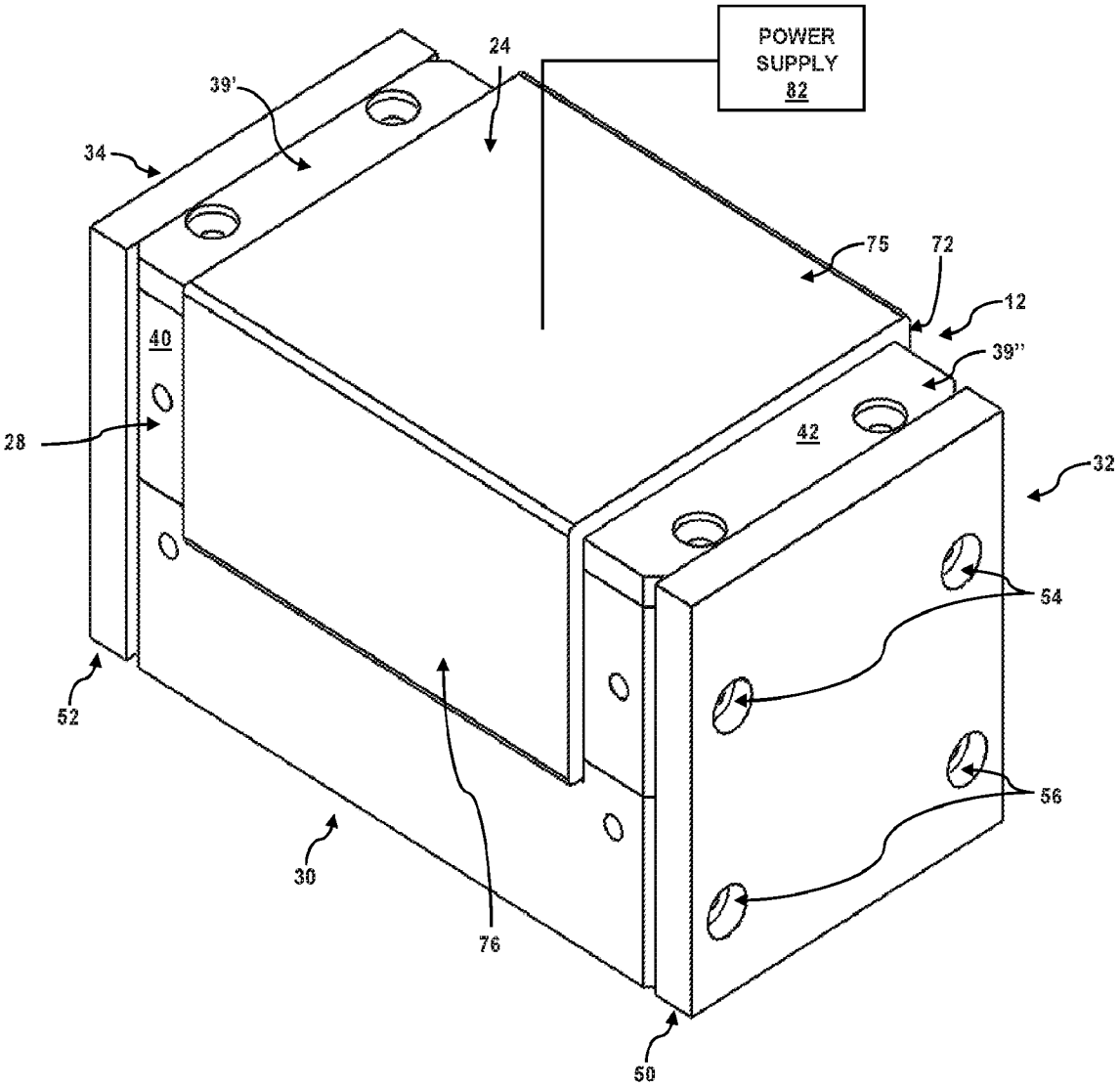
FIG. 2 is an isometric view of the device of FIG. 1 in an assembled state, in accordance with embodiments of the present disclosure.

Turning to the first embodiment illustrated in FIGS. 1 and 2, device 10 comprises a central housing 12 comprised of two, ferromagnetic (e.g., steel) housing components 28, 30 which may be joined by a pair of ferromagnetic, passive-pole extension pieces 32, 34. While pole extension pieces 32, 34 are depicted in the illustrated embodiment, the device 10 may function without the pole extension pieces 32, 34 in other embodiments. Two cylindrical and diametrically magnetized magnets 14, 16 may be respectively received within the upper and lower housing components 28, 30. In embodiments, the magnets 14, 16 may be NdFeB magnets. In embodiments, the active magnetic mass and magnetic properties of the magnets 14, 16 may be equal and/or equal within achievable manufacturing tolerances and permanent magnet magnetization technologies. The magnet 14 may be referred to herein as the upper magnet 14 and/or the second magnet 14 and the magnet 16 may be referred to herein as the lower magnet 16 and/or the first magnet 16. While it is discussed herein the upper magnet 14 is rotatable within the upper housing component 28 and the lower magnet 16 is fixed within the lower housing component 30, in other embodiments, the upper magnet 14 may be fixed within the upper housing component 28 and the lower magnet 16 may be rotatable within the lower housing component 30.

In embodiments, thin circular disk 18 of a ferromagnetic material may close the otherwise open lower end of a cylindrical cavity 38 extending through lower housing component 30. A multi-component support and spacing structure 20 may be located between the upper and lower magnets 14, 16. A non-magnetisable (e.g., aluminium) cap structure 22 may be mounted to the upper housing part 28 to cover the open upper end of a cylindrical cavity 36 extending through upper housing component 28.

In embodiments where the upper magnet 14 is rotatable, a solenoid coil body 24 may consist of enamel coated wire and may be wrapped about the upper housing part 28 and the cap structure/member 22. In another embodiment, the solenoid coil body 24 may be wrapped about the upper housing part 28 only, in which case the cap member 22 would be modified by having at width ward ends thereof downward extending footing portions that enable attachment of the cap to the housing part whilst accommodating the thickness of the coils between housing part and cap member. In another embodiment, the solenoid coil body 24 could be within the upper housing part 28 and wrapped about the upper magnet 14. In this embodiment, the upper housing part 28 could be modified to accommodate the thickness of the solenoid coil body 24. In addition, the solenoid coil body 24 may include enough wire to provide slack for rotation of the upper magnet 14 and/or a slip ring may be used to maintain an electrical connection between the solenoid coil body 24 and a power supply 82. In another embodiment, the solenoid coil body 24 could be wrapped about both the upper magnet 14 and lower magnet 16. In these embodiments, the solenoid coil body 24 could be wrapped about the lower housing component 30 of the lower magnet 16 or be disposed within the lower housing component 30 and wrapped about the lower magnet 16. While only one solenoid coil body 24 is depicted, in other embodiments, the solenoid coil body 24 may be comprised of multiple solenoid bodies. The purpose of the solenoid coil body 24 is discussed in more detail below.

In embodiments where the lower magnet 16 is rotatable, the solenoid coil body 24 may be wrapped about the lower housing component 30 and the cap structure 18. In another embodiment, the solenoid coil body 24 may be wrapped about the lower housing component 30 only, in which case the cap member 18 may be modified by having at width ward ends thereof downward extending footing portions that enable attachment of the cap to the housing part whilst accommodating the thickness of the coils between housing part and cap member. In another embodiment, the solenoid coil body 24 could be within the lower housing component 30 and wrapped about the lower magnet 16. In this embodiment, the lower housing component 30 could be modified to accommodate the thickness of the solenoid coil body 24. In addition, the solenoid coil body 24 may include enough wire to provide slack for rotation of the lower magnet 16 and/or a slip ring may be used to maintain an electrical connection between the solenoid coil body 24 and a power supply 82.

In embodiments, the two housing components 28, 30 may be identical and comprised of a rectangular parallelepiped block of low reluctance ferromagnetic material, with the centrally located cylindrical cavities 36, 38, extending through each block, perpendicular to upper and lower axial end faces (in FIG. 1 only the top faces 42, 44 are visible) for receiving, respectively, the upper and lower magnets 14, 16.

The diameter of cavities 36, 38 may be such that only a small web 37', 37" of material is present at diametrically opposite vertical sides 40 of the blocks 28, 30. The wall portions 39', 39" located at the other two parallel vertical side faces 43 and 45 of the blocks 28, 30, however, may have a thickness that is substantial and determined such as to allow magnetic flux generated by permanent magnets 14, 16 to be contained and redirected within these ferromagnetic wall sections or zones 39. The thin webs at 37' and 37" may substantially isolate the two housing zones 39' and 39" magnetically from one another so that these may be magnetized with opposite N- and S-polarities by the magnets 14, 16 received within the housing blocks 28, 30, respectively, and as noted below, without causing a magnetic flux short-circuit. In the illustrated embodiments, the thin web and thick wall portions 37 and 39 are identified only with reference to the lower housing block 30.

Cylindrical cavity 36 of upper housing block 28 may have a smooth wall surface, and is of such diameter to allow upper magnet 14 to be received therein so it can rotate with minimal friction and preferably maintain a minimal airgap. In embodiments, a friction reducing coating may be applied to the cylindrical cavity 36 surface.

In embodiments, cylindrical cavity 38 in the lower housing block 30 may have a roughened wall surface and a diameter selected such as to provide interference fit with the lower magnet 16 such that when magnet 16 is mounted within cavity 38, it maintains its rotational orientation and is prevented from axial and rotational displacement under operating conditions of the device 10. Additionally or alternatively, other mechanisms can be used, such as gluing or additional cooperating form-fitting components (not shown) to secure magnet 16 within cavity 38 against displacement.

As will be further noted from FIG. 1, a pair of parallel spaced apart, threaded bores 46, 47 may be cut into the opposite vertical exterior faces 43, 45 of the ferromagnetic wall sections 39', 39" of both housing blocks 28, 30. The bore pairs 46, 47 may extend perpendicular to the axis A of the central cavities 36, 38, and serve the purpose of providing anchoring for (not illustrated) fastening screws or bolts by way of which the pole extension blocks 32, 34 are removably secured to both central housing blocks 28, 30. In embodiments, there may be no or minimal air gap at the pole shoes 32, 34 and the housing wall sections by virtue of the housing wall sections 39" of the upper and lower housing blocks 28, 30 having a cross-section that is sufficient to carry the entire magnetic flux originating in the magnets 14, 16 without significant leakage beyond the confines of the ferromagnetic bodies, whereby the stacked wall portions 39" at one side of the upper and lower housing blocks 28, 30 have opposite polarities, as is the case with wall sections 39'.

The pole extension blocks 32 and 34 may be identical in configuration and comprised of a low magnetic reluctance ferromagnetic material, as used in the manufacture of passive magnetisable pole elements. While the pole extension blocks 32, 34 are depicted as having a parallelepiped, plate-like shape, the pole extension blocks may have other shapes, which may be based on the shape of a workpiece to which the device 10 will attach. Additional pole extension block arrangements are disclosed in U.S. Provisional Patent Application No. 62/623,407, filed Jan. 29, 2018, titled MAGNETIC LIFTING DEVICE HAVING POLE SHOES WITH SPACED APART PROJECTIONS, the entire disclosure of which is expressly incorporated by reference herein.

While the illustrated embodiments depict pole extension blocks 32, 34, the device 10 may not include pole extension blocks 32, 34 in other embodiments.

Vertical side faces 33, 35 of the blocks 32, 34 may be mated with the vertical side faces 43, 45 of central housing blocks 28, 30 have a surface finish and shape to enable a gap-free and surface-flush fit onto the outside faces 43, 45 of side walls 39', 39" of both housing blocks 28, 30. Faces 33, 35 are of sufficient size to fully cover faces 43 and 45 of both housing blocks 28, 30.

Each plate-like pole extension block 32 and 34 may include a pair of countersunk through bores 54 and 56, whose lateral spacing equals that of the threaded bore pairs 44, 46 at the housing blocks 28, 30, and whose spacing along cavity axis A is such as to fix the housing blocks 28, 30 in a spaced-apart manner by means of non-illustrated fastening bolts which extend through bores 54, 56 and are secured in threaded bores 46, 47 of housing blocks 28, 30. Both housing blocks 28, and 30 may thus be connected via the lateral pole extension blocks 32, 34 in a way which provides a substantially gap-free, low reluctance magnetic circuit path between the thick-wall portions 39', 39" of both housing blocks 28, 30 and the respective magnets 14, 16 received therein, whereby the cavities 36 and 38 and cylindrical magnets 14, 16 align co-axially and are concentric about axis A, and the vertical faces of each of the housing blocks 28, 30 are pair-wise coplanar.

In embodiments, the diametrically magnetized lower cylindrical magnet 16 is received and fixed against rotation in cavity 38 of lower housing block 30 in such manner that the N-S pole separation line (as illustrated by diameter line D on the top face of magnet 16) extends across the oppositely located thin wall webs 37' and 37" of block 30. In other words, the N-S axis of the permanent magnet 16, which extends perpendicular to said separation line, and is illustrated by arrow ML, is oriented such that opposite housing side walls 39' and 39" (and respectively associated pole extension blocks 32, 34) are magnetized in accordance with the active magnetic pole next to it. In FIG. 1, wall portion 39" is thus magnetized as a S-pole whereas wall portion 39' becomes a N-pole.

In contrast, because upper cylindrical magnet 14 within top housing block 28 is free to rotate about axis A, and relative to the lower housing block 30 with its fixed magnet 14, in absence of the pole extension blocks 32, 34 the polarity of the side walls 39' and 39" would be determined by the relative rotational position and orientation of the upper magnet's N-S axis MU, as is schematically illustrated in FIG. 1.

Figure 3B:
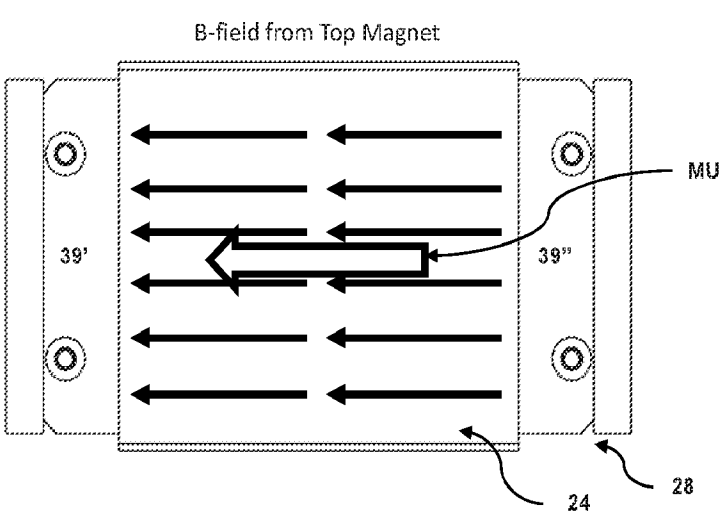
FIG. 3B is a top view of the device depicted in FIG. 3B and includes the B-field produced by the top magnet when the device is in an "off" position.
Figure 3A:
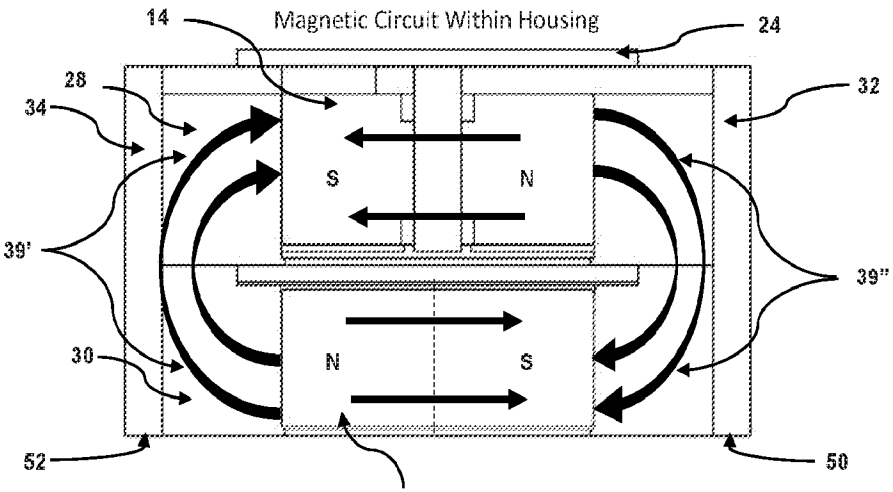
FIG. 3A is a front cross-sectional view of the device depicted in FIGS. 1 and 2 and the magnetic circuit created when the device is in an "off" position, in accordance with embodiments of the present disclosure.
Figure 3C:
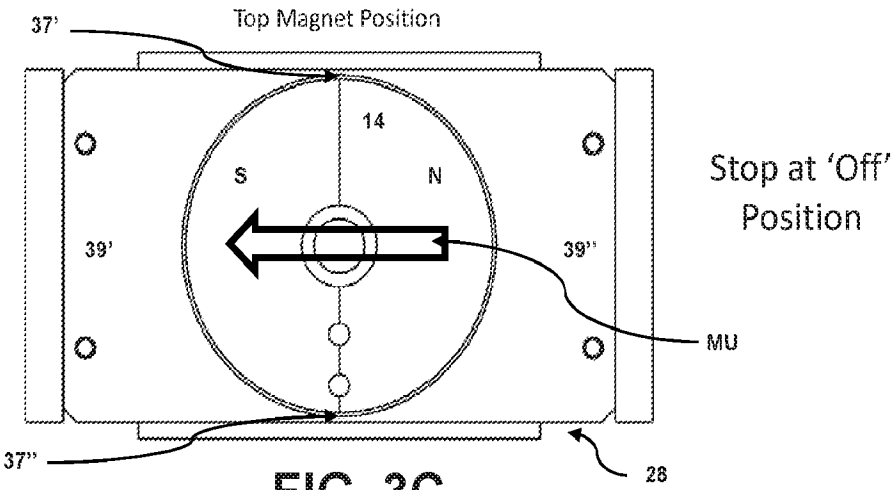
FIG. 3C is a top partial cross-sectional view of the device depicted in FIGS. 3A-3B and include the top magnet when the device is in an "off" position.
Figure 9B:
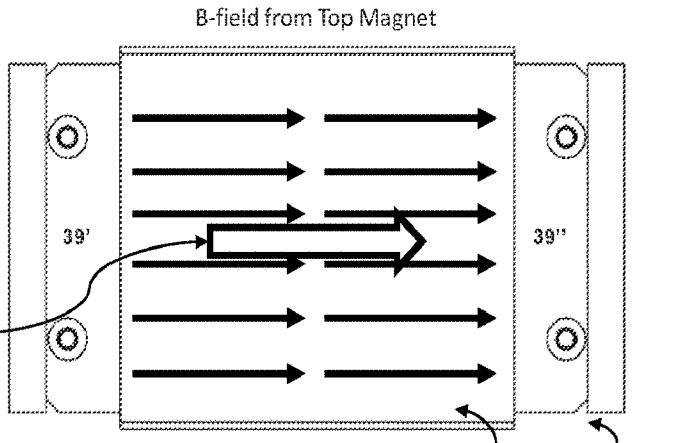
FIGS. 9B-9C are top views of the device depicted in FIGS. 1 and 2 and the B-field produced by the top magnet when the device is in an "on" position, in accordance with embodiments of the present disclosure.
Figure 9A:
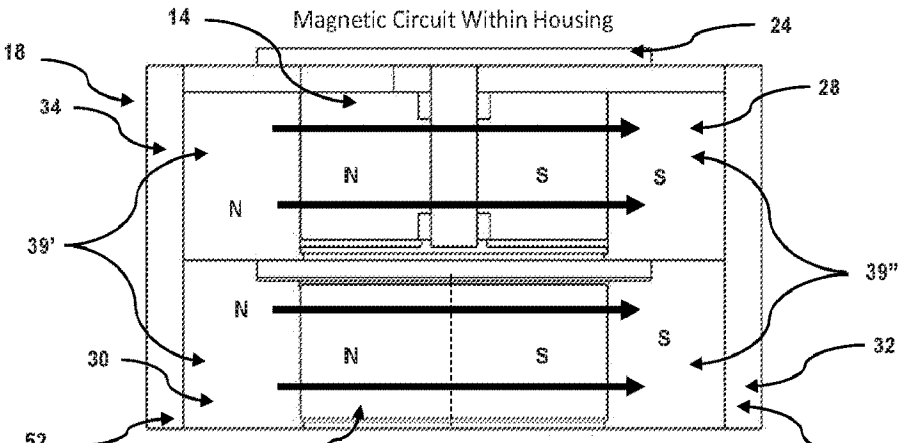
FIG. 9A is a front cross-sectional view of the device depicted in FIGS. 1 and 2 and the magnetic circuit created when the device is in an "on" position, in accordance with embodiments of the present disclosure.
Figure 9C:
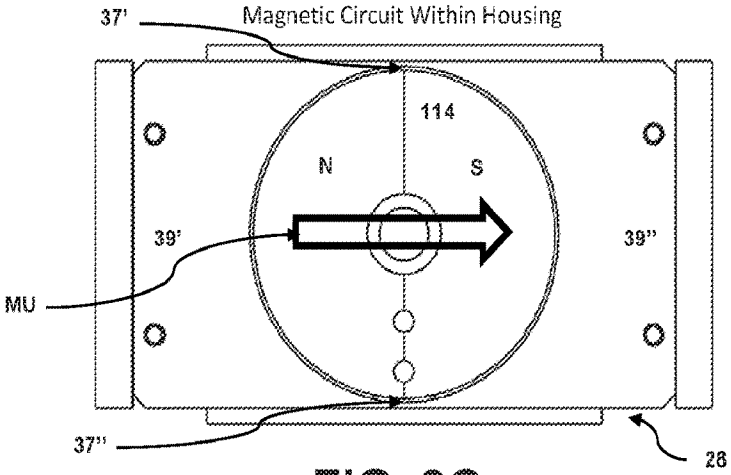

In embodiments, the upper magnet 14 is configured to be rotatable 180 degrees from the orientation shown in FIG. 1 to a rotational position in which its N-pole coincides with the N-pole of the lower magnet 16 and conversely the S-poles overlie each other (and the N-S axes MU and ML are oriented parallel). When the N-S axes MU and ML are oriented parallel, both side walls 39' of the upper and lower housing blocks 28 and 30 will be magnetized with the same N magnetic polarity, as will the adjoining pole extension block 32. Further, the other (opposite) side walls 39" will be magnetized with the same but opposite S-magnetic polarity, as will be the adjoining pole extension block 34. This re-orientation of upper magnet 14 will create an 'active' working air gap at the lower axial terminal faces 50, 52 of pole extension blocks 32, 34, thereby enabling the creation of a low reluctance, closed magnetic circuit to be formed originating and finishing in the magnets 14, 16, through the housing block walls 39', 39", the pole extension blocks 32, 34 and a ferromagnetic work piece that is perhaps touching both lower axial end faces 50, 52 of pole extension blocks 32, 34. As such, the pole extension blocks 32, 34 form the workpiece contact interface for the device 10. That is, the pole extension block 34 forms the N-pole portion of the workpiece contact interface of the device 10 and the pole extension block 32 forms the S-pole portion of the workpiece contact interface of the device 10. In other embodiments, one or more other portions of the housing block 30 may form the workpiece contact interface for the device 10. This state is referred to herein as the device 10 being in an "on" state and/or may be referred to as the upper magnet 14 being in a second position (shown in FIGS. 9A-9C, wherein FIG. 9A is a front sectional view of the device 10 and FIGS. 9B-9C are top views of the device 10). Conversely, the state where MU and ML are oriented anti-parallel and a closed magnetic circuit is formed within the device 10 is referred to as the device 10 being in an "off" state and/or the upper magnet 14 being in a first position (shown in FIG. 1 and FIGS. 3A-3C, wherein FIG. 3A is a front sectional view of the device 10, FIG. 3B is a top view of the device depicted in FIG. 3B and includes the B-field produced by the top magnet when the device is in an "off" position, and FIG. 3C is a top partial cross-sectional view of the device depicted in FIGS. 3A-3B and includes the top magnet when the device is in an "off" position).

In embodiments, the thin ferromagnetic bottom disk 18 may be press fitted or otherwise secured such as to close the lower open end of cylindrical cavity 38 in order to seal the cavity 38 and magnet 16 received therein against contamination at the working face of the magnet device 10. The ferromagnetic nature of disk 18 may assist in completing the magnetic circuit by providing additional magnetisable material between the polar ends of the housing block, so that the field of the lower permanent magnet 16 couples exclusively with the magnetic material provided in the housing block 28 and the pole extension blocks 32, 34 in order to form a magnetic circuit in either the on or off positions. This also allows for the device 10 to operate with greater holding force when turned on, and cancels out any holding force when turned off.

As noted above, device 10 further comprises a multi-component support and spacing structure 20 located between the upper and lower magnets 14, 16, devised to support the upper magnet 14 within the cylindrical wall of cavity 36 of upper housing block 28 and maintain a set axial distance between the lower circular face of the upper magnet 14 from the upper circular face of lower magnet 16 within lower housing block 30. In embodiments, the support and spacing structure 20 may include a circular bottom plate 60 of non-magnetisable metallic material, a rotation bearing 62 and a pedestal component 64 comprising a circular non-magnetic plate 63 whose upper face can preferably be coated with a slip promoting PTFE coating and whose lower face carries a boss or axle stump (not shown) made integral therewith. The bottom plate 60 rests on the upper face of the lower magnet 16 and closes the upper open end of cylindrical cavity 38 by being preferably transition-fitted into it. A ball or other type of bearing 62 may be seated in an appropriately sized cylindrical depression (or seat) 61 in the upper surface of the bottom plate 60. The pedestal's axle stump may sit within the inner ring bearing part of the bearing 62. The diameter of the non-magnetic circular plate 63 is such that it can rotate within the lower terminal axial end of cavity 36 of upper housing block 28, i.e., it has a diameter similar to that of the upper magnet 14 which sits with its lower axial end face on it.

In order to maintain upper magnet 14 co-axially centred within the cylindrical cavity 36 of upper housing block 28, a centering arrangement may be carried by the top cap 22 which covers the upper axial end face 42 of upper housing block 28. A through hole 66 may extend along the central axis A of upper cylindrical magnet 14, terminating at the opposite axial end faces of magnet 14 in respective, diameter-enlarged counter-bores into which are press-fitted non-magnetic bearings (not shown) that lie flush with the axial end faces of the cylindrical magnet 14. The combination of the through hole 66 and the bearings at either axial end of the magnet 14 allow for a shaft 69, which is rotationally supported at or fixed to cap component 22, to be received within upper magnet 14, thereby to centre the magnet's rotation within the top housing block 28.

This support structure 20 may be replaced by a different type of arrangement, in which the upper magnet 14 is secured against axial displacement at shaft 69 while allowing free rotation thereof, by way of a not illustrated retainer clip ring may be secured in an annular groove near the terminal lower end of shaft 69 which would thus slightly protrude past opening 66.

The non-magnetisable cap component 22, which in the illustrated embodiments of FIGS. 1 and 2 comprises a simple rectangular plate 84 with an arcuate window 85 as described below, may be fastened to the housing block itself. To fasten the non-magnetisable cap component 22 to the housing block, four threaded bores may extend vertically at the corners of upper axial 42 end face of upper housing block 28. Non-illustrated fastening bolts may extend through bores in the cap component 22. Alternatively, cap member 22 may be secured via bolts or other fasteners to the pole extension blocks 32, 34 or press fitted over an upper portion of the entire housing assembly.

In embodiments, cap component 22 may include part of a stop, pin, and/or latch mechanism 83 which operates to hold a rotational state of upper magnet 14 within its housing block 28 and thus equally secure a relative rotational position with respect to the fixed lower magnet 16. Additionally or alternatively, the stop, pin and/or latch mechanism 83 may limit and/or provide end points for rotation of the upper magnet 14. Additionally or alternatively, the stop, pin, and/or latch mechanism 83 may be included in the housing block 28 or another portion of the device 10. The stop, pin, and/or latch mechanism 83 may be a retractable pin as described in U.S. patent application Ser. No. 15/965,582, filed Apr. 27, 2018, titled VARIABLE FIELD MAGNETIC COUPLERS AND METHODS FOR ENGAGING A FERROMAGNETIC WORKPIECE, the entire disclosure of which is expressly incorporated by reference herein.

Cap member 22 may be further configured to support/house various electronic control and power components associated with and required to supply current to the solenoid coil body 24 as will be described below. Alternatively, cap member 22 may include contact leads for connecting to a power supply (not shown) that supplies current to the solenoid coil body 24.

As previously noted, shaft 69 penetrates the through hole 66 in the upper magnet 14, so that the upper magnet 14 may rotate coaxially around the shaft 69. In the embodiment illustrated, shaft 69 is a cylindrical pin welded or otherwise fixed to a central hub portion 86 of cap member 22. Alternatively, a rotatable shaft may be employed which may extend through the bottom of the cap member 22 via a through-hole, and a bearing would seat around the through-hole and shaft to centre it and assist in the rotation of the shaft 69 with the upper magnet 14. Above the portion of the cap member 22 bearing shaft 66 and other mechanical components, a second portion of the cap member 22 (not illustrated) may be unitary therewith or assembled to it, and may be allocated for housing the non-illustrated electronic components. This portion is isolated from the mechanical portion of the assembly, to prevent mechanical damage to the circuitry; however, shaft 69 may extend into the electronic housing section to allow for the attachment of a feedback device to the shaft, such as an encoder or limit switch, allowing control circuitry to detect the angular displacement of the upper magnet 14 vis a vis the lower magnet 16 and/or set reference points.

As illustrated in FIG. 1, the nonmagnetic plate 84 of cap component 22 may be machined to have a similar footprint to that of the housing blocks 28, 30, i.e., rectangular, with a central arc-like window 85 that corresponds in outer diameter to that of central cavity 36 of the upper housing block 28. The centre of curvature of arc-like window 85 may coincide with axis A of cylindrical cavity 36 and may be co-axial therewith. The central web portion 86 defines the radially-inner border of arc-like window 85 and carries the aforementioned support shaft 69 for centering upper magnet 14 within upper housing block 28. The terminal opposite ends 87, 88 ends of arc-like window 85 provide "hard stops" for a rotation arresting block member 89 which is fixed to the upper face of magnet 14 so that it may travel within slot 85 during rotation of the magnet 14 during switching operation of the device 10. The hard stops 87, 88 and arresting block 89 may cooperate in limiting rotation of the upper magnet 14 within cavity 36, as will be explained below, between two terminal positions which determine the on and off positions of the device.

Fixed shaft 69 protrudes perpendicular from the hub defined by central web portion 86, so that positioning of the shaft 69 by the installation of cap component 22 cooperates with upper magnet 14 to ensure its concentric rotation within the cylindrical cavity of upper housing block 28.

The solenoid coil body 24 may consist of enamel coated copper wire windings wrapped (or otherwise placed) around the upper housing block 28 as illustrated in FIG. 2. As noted above, however, the solenoid coil body 24 may also be wrapped or otherwise placed around the upper magnet 14. The solenoid coil body 24 may be placed such that vertically extending sections 72, 76 of the solenoid coil body 24 run along the pairwise vertical side faces 43, 45 of upper housing block 28 and horizontally extending sections 75, 77 run parallel with the (not visible) lower axial end face of housing block 28 and either the upper axial end face 42 of upper housing block 28 or the upper face of plate 84 of cap member 22.

In embodiments, the solenoid coil body 24 may comprise multiple solenoid coil bodies. For example, the solenoid coil body 24 may comprise two solenoid coil bodies that are electrically isolated from each other and extend from one corner of the housing 28, diagonally across the top face 42 of the upper housing block 28, to the opposing corner of the housing block 28, back underneath the top housing block 28. The respective coils may be wrapped on opposing diagonals across the upper housing 28 and cap member 22, one coil being wrapped over the other, so that they form an 'X' of windings when viewed in top plan view of housing 28. The windings may be guided on the horizontally extending sections below the upper housing block 28 to define a through hole 79 (as may be seen in FIG. 1) about axis A to permit downward passage of the support stump 62 of pedestal 64 of supporting structure 20 by way of which upper magnet 14 rests on lower magnet 16, in the embodiment of FIG. 1.

In embodiments in which the solenoid coil body 24 is wound about the upper housing block 28 prior to the cap member 22 being secured onto it, the horizontally extending sections 75, 77 above the upper housing 28 may be guided such as to define a through hole (not illustrated) about axis A to permit passage of the centering shaft or pin 69 which extends downwards from cap member 22 into upper rotatable magnet 14 to centre its co-axial rotation within cylindrical cavity 36 of upper housing block 28.

In embodiments, a power supply 82 may be connected to the solenoid coil body 24 via suitable control circuitry in order to supply a current to the solenoid coil body 24 in order to induce an H-field on the upper magnet 14 to facilitate rotation of the upper magnet 14 from an off position to an on position.

Specifically, FIGS. 4A, 5A, 6A, 7A, and 8A depict top views of the device 10 as the device 10 transitions from an off position to an on position and, more specifically, the FIGS. 4A, 5A, 6A, 7A, and 8A depict top views of the B-field created by the magnets 14, 16 on the housing 28. FIGS. 4B, 5B, 6B, 7B, 8B illustrate the direction of current flow through the magnetic solenoid body 24. FIGS. 4C, 5C, 6C, 7C, 8C illustrate the H-field produced by the current flowing through the solenoid coil body 24. FIGS. 4D, 5D, 6D, 7D, 8D illustrate the net magnetization state of the upper housing block 28 resulting from re-orientation of the rotatable upper magnet 14 and the H-Field superimposed onto it. And, FIGS. 4E, 5E, 6E, 7E, 8E illustrate the rotational position of the upper magnet 14 and its N-S pole axis MU commencing in the "off" state sequencing into the "on" state.

As depicted in FIGS. 4A-8E, an H-field may be induced by the solenoid coil body 24 in order to change the magnetization pattern which the upper housing block 28 experiences as a function of the rotational position of the upper magnet 14 received therein. That is, by applying a voltage to and thus current to flow through the windings of solenoid coil body 24, a magnetic H-field will be created within the perimeter of the coils that is perpendicular to the current flow direction and whose N-S orientation vector will be determined by the circulation direction of current within the solenoid coil body 24. It will also be understood that a distinction may be drawn between H-fields and B-fields. The H-Field is defined as the magnetic field strength, is alternatively called the magnetizing field, and will be used in referring to the effect which the solenoid coil body 24 has on the housing block 28. The B-field is the magnetic field flux, and arises as a combination of magnetic field sources, either electrical or permanent in nature, and the magnetization of a medium. As the B-field is normally considered when calculating the mechanical torque exerted on a magnetic dipole, the B-field will be used when referring to the rotation of the upper magnet 14 and the switching operation of the device as described below.

The H-field generated by the solenoid coil body 24 will be a function of coil winding turns, cross-section of the coils and current flow within the solenoid coil body 24. At least a component of the H-field generated by the solenoid coil body 24 will be directed from S to N along the active N-S pole pair of the upper magnet 14 when the upper magnet 14 is in a first position (e.g., as shown in FIGS. 1, 4A-4E). As a consequence of an H-field created by applying a voltage and thus current flow in solenoid coil body 24, the upper housing block 28 will become magnetized to a degree dictated by the relative permeability of the ferromagnetic material which comprises housing block 28. In at least one example, the strength of the H-field created by the solenoid coil body 24 may be constant as the upper magnet 14 rotates from the off position to the on position. In another example, the strength of the H-field created by the solenoid coil body 24 may vary by varying the current through the solenoid coil body 24 as the upper magnet 14 rotates form the off position to the on position. Additionally or alternatively, the direction of the H-field created by the solenoid coil body 24 may vary by varying the direction of the current through the solenoid coil body 24 as the upper magnet 14 rotates from the off position to the on position in order to provide a braking function and/or to facilitate rotation of the upper magnet from the on position to the off position.

In at least some embodiments, the H-field created by the solenoid cold body 24 may be oriented at an angle relative to the B-field produced by the upper magnet 14 (shown in FIGS. 4A-4E). In these embodiments, the magnetization of housing block 28 in turn creates a B-field within the volume of housing block 28 which is able to apply a mechanical torque to upper magnet 14.

As depicted in FIGS. 4A-8E, the device 10 can be switched from an "off" state (FIGS. 4A-4E) in which no or a relatively small magnetic field is available for use by a ferromagnetic work piece even when in contact with the lower faces 50, 52 of passive pole blocks 32, 34 into an "on" state (FIGS. 8A-8E) in which the passive pole blocks 32, 34 are magnetised with opposite polarities, and an external flux exchange path can be created by bringing the passive pole blocks 32, 34 into contact with a ferromagnetic work piece, thus magnetically retaining the device 10 attached to such work piece.

In the "off" switching position off device 10, upper permanent magnet 14 in the top housing block 28 and lower magnet 16 in the bottom housing block 30 are rotationally set such that the N-pole of the upper magnet substantially aligns with the S-pole of the lower magnet 16 and the S-pole of upper magnet 14 substantially aligns with the N-pole of the lower magnet 16, viewed in top plan view of the device 10, such as is illustrated in FIGS. 1 and 4A. That is, the magnetic N-S axis MU and ML of upper and lower magnet, respectively, are parallel aligned in opposite directions. In this off-state of the device 10, a closed magnetic circuit exists between the magnets 14, 16 and housing blocks 28, 30 via the thick wall sections 39', 39" about the cavity housing the magnets 14, 16 and pair of pole extension blocks 32, 34, which provide a low reluctance magnetic flux path between the upper and lower housing blocks 28, 30 effectively shunting the circuit within device 10.

In order to turn the device 10 into the "on" position, in which the pole shoes at the lower end of wall sections 39', 39" and/or pole extension blocks 32 and 34 exhibit opposite polarities, current may be supplied to the solenoid coil body 24, as depicted in FIGS. 4B, 5B, 6B, 7B, 8B. As the solenoid coil body 24 is activated, the electrically induced magnetic field(s) depicted in FIGS. 4C, 5C, 6C, 7C, 8C alter the direction and net magnitude of the resultant B-field vector (provided by the vectors of the permanent magnets and coil magnets) which magnetize the upper housing block 28 (depicted in FIGS. 4D, 5D, 6D, 7D, 8D) as the upper magnet 14 rotates from an off position to an on position (depicted in FIGS. 4E, 5E, 6E, 7E, 8E).

The electrically generated magnetic field(s) may be chosen such as to influence and change the magnetic circuit formed between the two permanent magnets 14, 16 and the adjoining housing wall sections 39', 39". With sufficient current, the magnetic field component within the top housing block 28 created by the fixed lower magnet 16 in the bottom housing block 30 via the wall sections 39', 39" and/or the connecting pole extension blocks 32, 34 can be cancelled out, thus cancelling out the magnetic influence of the lower magnet 16 on the upper magnet 14. This then leaves the field created by the solenoid coil body 24 as the primary magnetic field source in the top housing block 28, aside from that of the rotatable magnet 14 itself. As a result, rotating the upper magnet 14 from a first position to a second position to switch the switchable magnet device to an "on" position will require less torque. In some exemplary embodiments, the solenoid coil body 24 may be oriented at an angle relative to the upper magnet 14 when the upper magnet 14 is in a first position (shown in FIGS. 4B, 5B, 6B, 7B, and 8B), which will impart a torque on the upper magnet 14.

In at least one example, the solenoid coil body 24 may include more than one coil that are oriented in different directions. If the coils of the solenoid coil body 24 are supplied with current in a direction wherein at least a component of the H-field is not parallel with the inherent magnetic field generated by the upper magnet 14 given that the magnetic field created by the solenoid coil body 24 is rotationally offset from the inherent magnetic field generated by the upper magnet 14 in its off-position, a torque is generated as the upper magnet 14 seeks to realign its N-S axis MU to follow the induced magnetic B-field axis and polarity induced by the solenoid coil body 24 onto the magnetisable wall sections 39' and 39" of the upper housing block 28, causing it to rotate within the top housing block 28 without other external influences.

Given sufficient torque as applied to the magnet 14 by the induced B-field that results from the magnetization of the housing block 28, the upper magnet 14 is able to rotate until the respective N- and S-pole of the upper magnet 14 are aligned with the respective N- and S-pole of the lower magnet 16, rendering the unit 10 in the "on" state. At this point, the solenoid coil body 24 can be deactivated. With both of the permanent magnets 14, 16 now having parallel aligned N-S axes oriented in the same direction, as seen in FIGS. 9A-9C, the thick wall sections 39' and 39" of the housing blocks 28, 30 and/or the pole extension blocks 32 and 34 become magnetized with opposite polarities. As a consequence, the device 10 effectively forms a permanent dipole magnet that can create a closed magnetic circuit with an external ferromagnetic work piece, without the need for power to be continuously applied to the solenoid coil body 24, when brought in contact with the passive pole extension rails or 'shoes' 32, 34. Additionally or alternatively, a stop, pin, and/or latch mechanism 83 may be included in the housing block 28 or another portion of the device 10 to hold the upper magnet 14 substantially in the second position.

The "on" position of the device is a stable but labile one, i.e., a point at the top of the saddle like magnetic potential curve defined by the two interacting permanent magnet fields, in which small external forces, magnetic imbalances between the permanent magnets 14, 16 of the device 10 or misalignment of the N-S axes of the magnets from a true parallel state will cause the magnetic field between the two magnets 14, 16 in the housing 28, 30 to naturally impart a small torque which can be sufficient to cause the upper magnet 14 to turn back into the off position, i.e. into the magnetically stable lower potential state by itself. Accordingly, and as set forth above for practical reasons and to accommodate manufacturing tolerances, the device 10 may include a stop, pin and/or latch mechanism 83 to selectively retain the upper magnet 14 in the "on" position of the device and release same as and when appropriate. As noted above, this can be a simple hard stop arrangement. As an example, this could consist of an arm component attached to the shaft 69 which is rotationally coupled with upper magnet 14, and two stop blocks mounted onto the top cap member 22 at rotational positions about the axis of rotation of shaft 69 indicative of the "on" and "off" positions of device 10.

Preferably, stop, pin, and/or latch mechanism 83 may be included in the arc-like slot 85 in cap member 22, in particular the terminal, radially extending terminal ends 87, 88 of the slot 85, and the non-magnetic material arresting block 89 secured against movement to protrude upwards from the top face of the upper magnet 14 and which is shaped (in plain view) to fit within and travel in the arc slot 85 during rotation of upper magnet 14 between the end stops. In other words, the length of the arc slot is at least 180 degrees to allow the upper rotatable magnet 14 to attain with its N-S axis MU a parallel or anti-parallel orientation with the N-S axis ML of the fixed magnet 16.

Preferably, the arc slot 85 will extend over an arc greater than 180 degrees, so as to provide a hard stop 88 against which the block 89 secured at the upper magnet 14 for rotation therewith can come to rest in which the upper magnet 14 has been rotated slightly beyond the "full on" position. In this 'over-rotated' position, the B-field of the lower magnet 16 applies a torque of sufficient value on the upper magnet 14 such as to bias the upper magnet 16 to maintain the stop position at the hard stop 88.

By sequencing a set of isolated, offset coils included in the solenoid coil body 24 correctly (in embodiments including more than one solenoid coil in the solenoid coil body 24), then, the upper magnet 14 can be rotated from its starting position, 0 degrees as regards a reference line indicating the off position of the device 10 (see FIGS. 4A-4E), up to the full on position of the device 10, by 180 degrees, and slightly further, between 180 and 185 degrees, to hit the hard stop, as shown in FIGS. 8A-8E. As a consequence, the upper magnet 14 is still near to full alignment with the lower magnet 16, but is locked in position against the hard stop, allowing for the device to remain "on" in a failsafe state.

The stop, pin, and/or latch mechanism 83 may be used to stop the upper magnet 14 prior to being rotated 180 degrees. In one of these intermediate states, the field strength (or level) of the device 10 at a workpiece contact interface is greater than when the device 10 is in an "off" state and less than when the device 10 is in an "on" state. As a result of being in one of these intermediate states, the device 10 may be configured to produce variable magnetic fields. Additional details on exemplary variable magnetic field systems are provided in U.S. patent application Ser. No. 15/965,582, filed Apr. 23, 2018, titled VARIABLE FIELD MAGNETIC COUPLERS AND METHODS FOR ENGAGING A FERROMAGNETIC WORKPIECE, the entire disclosures of which are expressly incorporated by reference herein.

By briefly reversing the energy supply sequence of a set of isolated, offset coils in the solenoid coil body 24, the upper magnet 14 can be "pulled" off of the hard stop by the B-field induced within the coils, and rotated past 180 degrees in the opposite direction of the "on" rotation; once past the full on point, the upper magnet 14 will naturally seek to return to the off position due to the B-field of the lower magnet 16, allowing the device 10 to essentially switch itself to the "off" state without much additional assistance from the solenoid coil body 24 beyond the current impulse required to achieve sufficient torque to counter the over-stop bias torque. Once turned off, the pole extension pieces 32, 34 and/or the workpiece to which the device 10 was being coupled to may be degaussed. In embodiments, the device 10 may include a mechanism to lock the upper magnet 14 in a first position while the pole extension pieces 32, 34 and/or the workpiece to which the device 10 was being coupled to are degaussed. Additional details regarding systems providing degaussing functionality are provided in U.S. patent application Ser. No. 15/964,884, filed Apr. 27, 2018, titled MAGNETIC COUPLING DEVICE WITH AT LEAST ONE OF A SENSOR ARRANGEMENT AND A DEGAUSS CAPABILITY, the entire disclosure of which are expressly incorporated by reference herein, the entire disclosure of which are expressly incorporated by reference herein.

In addition, this switch off process can be used to the advantage of the coil driving electronics. As the upper magnet 14 rotates back to the off position, the magnetic field orientation of the rotating upper magnet 14 changes relative to the normal of the plane of the coils included in the solenoid coil body 24, i.e. one has a rotating B-field traversing stationary current conductors, i.e. the coil windings. This induces a voltage in the coils included in the solenoid coil body 24 which induces current flow in the windings. An appropriate drive and control circuitry with energy storage facility (capacitors, batteries) can be provided at the cap component 22 so as to harness and return power to the coil driving circuit, recovering some of the energy lost in (magnetically) imparting torque onto the upper magnet 14 to switch device 10 from its off into its on state.

As a result of this cycle and design of the device 10, and the possibility of energy recovery, preferred embodiments of the present invention represent a significant improvement over older technologies. Unlike existing electro-permanent magnet systems, which require significant current to be applied to magnetizing coils for both actuation and deactivation of the device, the above described embodiment of the present invention only requires power for a short time during half of a switching cycle, and a significant part of the power invested in switching the device 10 from its off into its on state can be recovered during the deactivation half of the switching cycle. This allows for significantly more efficient operation than existing electro permanent systems with fixed magnets.

In addition, electro-permanent systems are inherently limited in their ability to form magnetic circuits under certain conditions. Though the magnetic flux output of AlNiCo magnets typically used as the switchable magnet in electro permanent systems, can be as high as the flux output of modern rare-earth magnets, the coercivity of AlNiCo is significantly lower than that of rare earth magnetic substrates. In "loaded" magnetic circuits, where several air gaps or low-relative-permeability materials are present, the AlNiCo would be unable to retain much magnetization, greatly impacting the overall strength of the resulting magnetic field.

In the preferred embodiments of the present invention, both of the permanent magnet elements consist of the same rare earth magnetic material, and as such, both have the same high coercivity. Thus, even in extremely unfavourable magnetic circuits, devices 10 according to the present invention are able to retain much more magnetic field strength than a corresponding electro permanent unit of comparable size and active magnetic material volume. This greatly expands the flexibility of electrically actuated switchable permanent magnet systems.

Figure 10C:
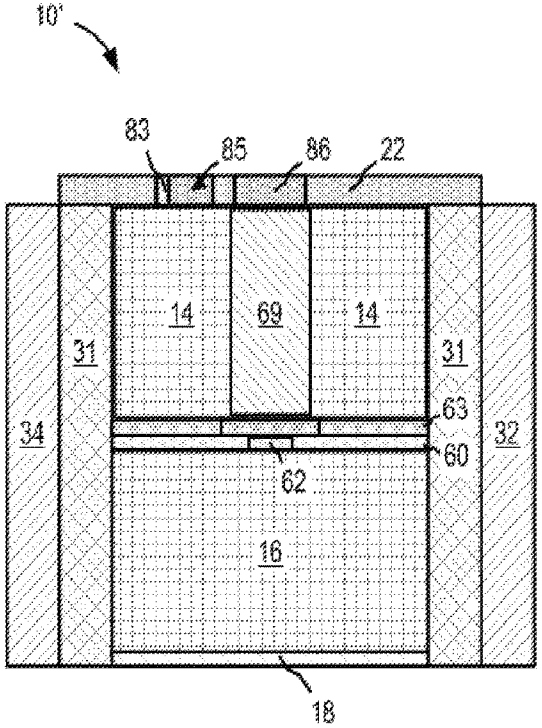
FIG. 10C is a side cross-sectional view of the electrically, switchable permanent magnetic device depicted in FIGS. 10A and 10B.
Figure 10B:
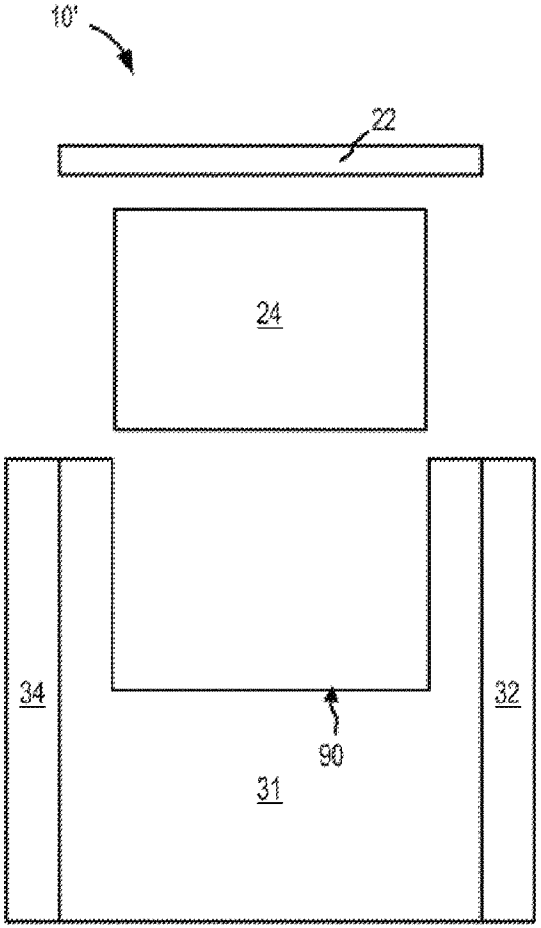
FIG. 10B is a side view of the electrically, switchable permanent magnetic device depicted in FIG. 10A with the cap structure and solenoid coil body removed from device.
Figure 10A:
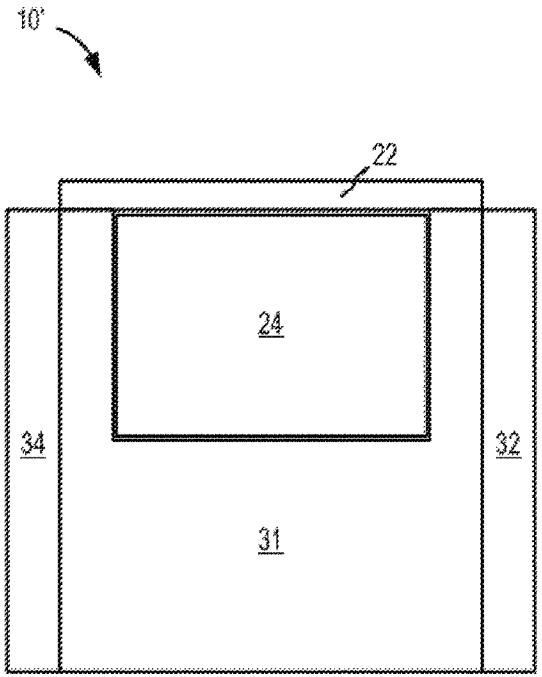
FIG. 10A is a side view another embodiment of an electrically, switchable permanent magnetic device, in accordance with embodiments of the present disclosure.

FIG. 10A is a side view another embodiment of an electrically, switchable permanent magnetic device 10'; FIG. 10B is a side view of the electrically, switchable permanent magnetic device depicted in FIG. 10A with the cap structure 22 and solenoid coil body 24 removed from device; and, FIG. 10C is a side cross-sectional view of the electrically, switchable permanent magnetic device depicted in FIGS. 10A and 10B. Like reference numerals designate corresponding similar parts.

The device 10' functions similar to the device 10, however, the device 10' includes a single-piece housing 31 instead of the two-piece housing included in the device 10. To accommodate the solenoid coil body 24 and upper magnet 14, the housing 10' includes a cutout 90 that receives the solenoid coil body 24. Similar to the device 10, the upper magnet 14 of the device 10' is arranged within the solenoid coil body 24. And, the lower magnet 16 is arranged within a bottom portion of the housing 31 (shown in FIG. 10C). Once the lower magnet 16 and the solenoid coil body 24 are arranged within the cutout 90 of the housing 10', the cap structure 22 is secured to the top of the housing 31.

Figure 11:
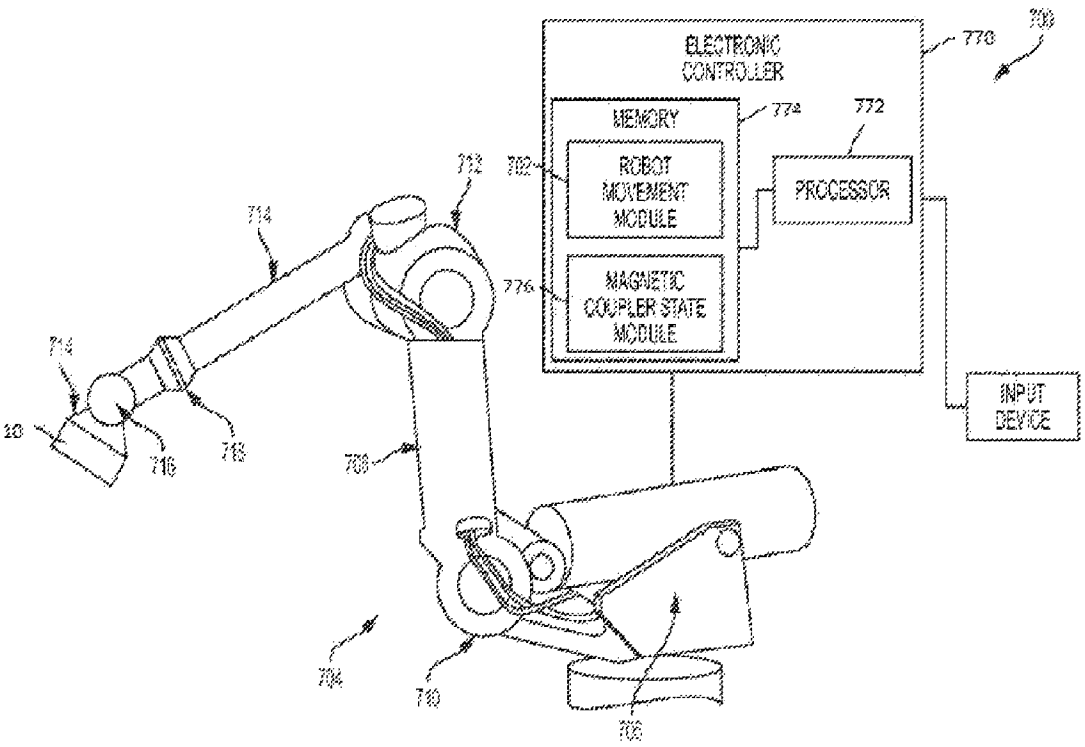
FIG. 11 illustrates a robotic system including a switchable magnetic device, in accordance with embodiments of the present disclosure.

In exemplary embodiments, the device 10, 10' may be incorporated into a robotic system. Referring to FIG. 11, an exemplary robotic system 700 is illustrated. While a robotic system 700 is depicted in FIG. 11, the embodiments described in relation thereto may be applied to other types of machines, (e.g., crane hoists, pick and place machines, etc.).

Robotic system 700 includes electronic controller 770. Electronic controller 770 includes additional logic stored in associated memory 774 for execution by processor 772. A robotic movement module 702 is included which controls the movements of a robotic arm 704. In the illustrated embodiment, robotic arm 704 includes a first arm segment 706 which is rotatable relative to a base about a vertical axis. First arm segment 706 is moveably coupled to a second arm segment 708 through a first joint 710 whereat second arm segment 708 may be rotated relative to first arm segment 706 in a first direction. Second arm segment 708 is moveably coupled to a third arm segment 711 through a second joint 712 whereat third arm segment 711 may be rotated relative to second arm segment 708 in a second direction. Third arm segment 711 is moveably coupled to a fourth arm segment 714 through a third joint 716 whereat fourth arm segment 714 may be rotated relative to third arm segment 711 in a third direction and a rotary joint 718 whereby an orientation of fourth arm segment 714 relative to third arm segment 711 may be altered. Magnetic coupling device 10 is illustratively shown secured to the end of robotic arm 704. Magnetic coupling device 10 is used to couple a workpiece 27 (not shown) to robotic arm 704. Although magnetic coupling device 10 is illustrated, any of the magnetic coupling devices described herein and any number of the magnetic coupling devices described herein may be used with robotic system 700.

In one embodiment, electronic controller 770 by processor 772 executing robotic movement module 702 moves robotic arm 704 to a first pose whereat magnetic coupling device 100 contacts the workpiece at a first location. Electronic controller 770 by processor 772 executing a magnetic coupler state module 776 instructs magnetic device 10 to move upper magnet 12 relative to lower magnet 14 to place magnetic coupling device 10 the on-state to couple the workpiece to robotic system 700. Electronic controller 770 by processor 772 executing robotic movement module 702 moves the workpiece from the first location to a second, desired, spaced apart location. Once the workpiece is at the desired second position, electronic controller 770 by processor 772 executing magnetic coupler state module 776 instructs magnetic device 10 to move upper magnet 12 relative to lower magnet 14 to place magnetic coupling device 10 in an off-state to decouple the workpiece from robotic system 700. Electronic controller 770 then repeats the process to couple, move, and decouple another workpiece.

In one embodiment, the disclosed magnetic devices include one or more sensors to determine a characteristic of the magnetic circuit present between the magnetic device and the workpiece to be coupled to the magnetic device. Further details of exemplary sensor systems are provided in U.S. patent application Ser. No. 15/964,884, filed Apr. 27, 2018, titled MAGNETIC COUPLING DEVICE WITH AT LEAST ONE OF A SENSOR ARRANGEMENT AND A DEGAUSS CAPABILITY, the entire disclosure of which are expressly incorporated by reference herein.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A magnetic coupling device for magnetic coupling to a ferromagnetic workpiece, comprising:

a plurality of pole portions in a spaced apart parallel arrangement along a first horizontal axis, each of the plurality, of pole portions having a workpiece contact interface;

a plurality of permanent magnets positioned relative to the plurality of pole portions, including a first permanent magnet of the plurality of permanent magnets positioned between a first pole portion of the plurality of pole portions and a second pole portion of the plurality of pole portions and positioned vertically offset from the workpiece contact interface of the first pole portion and the workpiece contact interface of the second pole portion and a second permanent magnet positioned between at least two of the plurality of pole portions and positioned vertically offset from the workpiece contact interfaces of the at least two of the plurality of pole portions;

a plurality of electrical windings wrapped about the first permanent magnet extending over the top of the first permanent magnet and under the bottom of the first permanent magnet, the plurality of electrical windings positioned between the first pole portion of the plurality of pole portions and the second pole portion of the plurality of pole portions; and an electronic controller operatively coupled to the plurality of electrical windings and controlling a magnetic circuit through the ferromagnetic workpiece at the workpiece contact interfaces of the plurality of pole portions, wherein the electronic controller establishes a first state of the magnetic circuit through the ferromagnetic workpiece at the workpiece contact interfaces of the plurality of pole portions with a first configuration of the plurality of permanent magnets and a second state of the magnetic circuit through the ferromagnetic workpiece at the workpiece contact interfaces of the plurality of pole portions with a second configuration of the plurality of permanent magnets.

2. The magnetic coupling device of claim 1, wherein the electronic controller transitions the magnetic circuit between the first state and the second state by controlling a current through the plurality of electrical windings.

3. The magnetic coupling device of claim 2, wherein when the magnetic circuit is in the first state, the first state is maintained in the absence of the current through the electrical windings.

4. The magnetic coupling device of claim 1, wherein when the magnetic circuit is in the first state, the first state is maintained in the absence of the current through the electrical windings.

5. The magnetic coupling device of claim 1, wherein when the plurality of electrical windings are positioned vertically offset from the workpiece contact interface of the first pole portion and the workpiece contact interface of the second pole portion.

6. The magnetic coupling device of claim 1, wherein the first permanent magnet is vertically positioned between a lower surface of the first pole portion and an upper surface of the first pole portion.

7. The magnetic coupling device of claim 1, wherein in the first state a first level of a magnetic field is available for use by the ferromagnetic workpiece when in contact with the workpiece contact interfaces of the plurality of pole portions.

8. The magnetic coupling device of claim 7, wherein in the second state a second level of the magnetic field is available for use by the ferromagnetic workpiece when in contact with the workpiece contact interfaces of the plurality of pole portions, the second level being greater than the first level.

9. The magnetic coupling device of claim 1, wherein the first permanent magnet is a rare-earth magnet.

10. The magnetic coupling device of claim 1, wherein the second permanent magnet is a rare-earth magnet.

11. The magnetic coupling device of claim 1, wherein the first permanent magnet is moveable relative to the second permanent magnet.

12. The magnetic coupling device of claim 1, wherein the at least two of the plurality of pole portions are the first pole portion and the second pole portion.

* * * * *